US008858332B2

(12) United States Patent
Arezina et al.

(10) Patent No.: US 8,858,332 B2
(45) Date of Patent: Oct. 14, 2014

(54) HANDHELD DEVICE FOR WAGERING GAMES

(75) Inventors: Vladimir I. Arezina, Chicago, IL (US); Thomas M. Kopera, Villa Park, IL (US); Larry J. Pacey, Northbrook, IL (US); David Pryor, Westmont, IL (US); Richard T. Schwartz, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1258 days.

(21) Appl. No.: 12/159,299

(22) PCT Filed: Jan. 11, 2007

(86) PCT No.: PCT/US2007/000792

§ 371 (c)(1),
(2), (4) Date: Jun. 26, 2008

(87) PCT Pub. No.: WO2007/089410

PCT Pub. Date: Aug. 9, 2007

(65) Prior Publication Data

US 2009/0005165 A1 Jan. 1, 2009

Related U.S. Application Data

(60) Provisional application No. 60/762,744, filed on Jan. 27, 2006.

(51) Int. Cl.
*A63F 9/24* (2006.01)
*G07F 17/32* (2006.01)

(52) U.S. Cl.
CPC ..... *G07F 17/32* (2013.01); *G07F 17/3244* (2013.01)
USPC ..... 463/37

(58) Field of Classification Search
USPC ..... 463/37
See application file for complete search history.

(56) References Cited

U.S. PATENT DOCUMENTS

| | | | | |
|---|---|---|---|---|
| 4,455,025 | A | 6/1984 | Itkis | 273/237 |
| 4,624,462 | A | 11/1986 | Itkis | 273/237 |
| 5,102,138 | A | 4/1992 | Johnson | 273/144 |
| 5,618,232 | A | 4/1997 | Martin | 463/25 |
| 6,001,016 | A | 12/1999 | Walker et al. | 463/42 |
| 6,012,983 | A | 1/2000 | Walker et al. | 463/20 |
| 6,104,815 | A | 8/2000 | Alcorn et al. | 380/258 |
| 6,117,013 | A | 9/2000 | Eiba | 463/41 |

(Continued)

FOREIGN PATENT DOCUMENTS

| | | | |
|---|---|---|---|
| WO | WO9634368 A1 | 10/1996 | G07C 15/00 |
| WO | WO04000428 A1 | 12/2003 | A63F 3/08 |

(Continued)

OTHER PUBLICATIONS

PCT International Search Report for Application No. PCT/US2007/00792 dated Oct. 26, 2007 (2 pages).

(Continued)

*Primary Examiner* — David L Lewis
*Assistant Examiner* — Shauna-Kay Hall
(74) *Attorney, Agent, or Firm* — Nixon Peabody LLP

(57) ABSTRACT

A gaming system for playing a wagering game on a handheld gaming machine includes a handheld gaming machine configured to play the wagering game and an external system configured to regulate wagering game play on the handheld gaming machine.

15 Claims, 6 Drawing Sheets

(56) References Cited

U.S. PATENT DOCUMENTS

| | | | | |
|---|---|---|---|---|
| 6,270,410 | B1 | 8/2001 | DeMar et al. | 463/42 |
| 6,409,602 | B1 | 6/2002 | Wiltshire et al. | 463/42 |
| 6,508,710 | B1 | 1/2003 | Paravia et al. | 463/42 |
| 6,524,188 | B2 * | 2/2003 | Wang | 463/37 |
| 6,527,638 | B1 | 3/2003 | Walker et al. | 463/25 |
| 6,628,939 | B2 | 9/2003 | Paulsen | 455/414 |
| 6,665,715 | B1 | 12/2003 | Houri | 709/223 |
| 6,676,522 | B2 | 1/2004 | Rowe et al. | 463/42 |
| 6,682,421 | B1 | 1/2004 | Rowe et al. | 463/25 |
| 6,800,029 | B2 | 10/2004 | Rowe et al. | 463/25 |
| 6,843,725 | B2 | 1/2005 | Nelson | 463/40 |
| 6,846,238 | B2 * | 1/2005 | Wells | 463/39 |
| 6,887,151 | B2 | 5/2005 | Leen et al. | 463/16 |
| 6,923,724 | B2 | 8/2005 | Williams | 463/42 |
| 6,935,952 | B2 | 8/2005 | Walker et al. | 463/25 |
| 6,971,956 | B2 | 12/2005 | Rowe et al. | 463/25 |
| 7,331,868 | B2 | 2/2008 | Beaulieu et al. | 463/30 |
| 2002/0068631 | A1 | 6/2002 | Raverdy et al. | 463/42 |
| 2002/0086729 | A1 | 7/2002 | Emmerson et al. | 463/41 |
| 2002/0147047 | A1 | 10/2002 | Letovsky | 463/42 |
| 2002/0147049 | A1 | 10/2002 | Carter, Sr. | 463/42 |
| 2002/0151363 | A1 | 10/2002 | Letovsky et al. | 463/40 |
| 2002/0183107 | A1 | 12/2002 | Wolfe | 463/17 |
| 2003/0006931 | A1 | 1/2003 | Mages | 342/357.06 |
| 2003/0008703 | A1 | 1/2003 | Gauselmann | 463/20 |
| 2003/0069056 | A1 * | 4/2003 | Cormack et al. | 463/16 |
| 2003/0104865 | A1 | 6/2003 | Itkis et al. | 463/40 |
| 2003/0139190 | A1 | 7/2003 | Steelberg et al. | 455/456 |
| 2003/0224855 | A1 | 12/2003 | Cunningham | 463/41 |
| 2004/0038725 | A1 * | 2/2004 | Kaminkow | 463/20 |
| 2004/0087370 | A1 | 5/2004 | Tarantino | 463/42 |
| 2004/0137987 | A1 | 7/2004 | Nguyen et al. | 463/42 |
| 2004/0140989 | A1 | 7/2004 | Papageorge | 345/700 |
| 2004/0162124 | A1 | 8/2004 | Barton | 463/1 |
| 2004/0193431 | A1 | 9/2004 | Campbell | 705/1 |
| 2004/0198489 | A1 * | 10/2004 | Kaminkow et al. | 463/20 |
| 2004/0224769 | A1 | 11/2004 | Hansen et al. | 463/40 |
| 2004/0266517 | A1 * | 12/2004 | Bleich et al. | 463/20 |
| 2005/0003883 | A1 | 1/2005 | Muir et al. | 463/16 |
| 2005/0009600 | A1 | 1/2005 | Rowe et al. | 463/29 |
| 2005/0026697 | A1 | 2/2005 | Balahura et al. | 463/42 |
| 2005/0037708 | A1 | 2/2005 | Torvinen | 455/41.2 |
| 2005/0130728 | A1 * | 6/2005 | Nguyen et al. | 463/16 |
| 2005/0143169 | A1 * | 6/2005 | Nguyen et al. | 463/25 |
| 2005/0187020 | A1 | 8/2005 | Amaitis et al. | 463/42 |
| 2005/0193209 | A1 | 9/2005 | Saunders et al. | 713/182 |
| 2005/0197190 | A1 | 9/2005 | Amaitis et al. | 463/42 |
| 2005/0227770 | A1 | 10/2005 | Papulov | 463/42 |
| 2006/0035707 | A1 * | 2/2006 | Nguyen et al. | 463/29 |
| 2006/0189382 | A1 | 8/2006 | Muir et al. | 463/29 |
| 2006/0205459 | A1 * | 9/2006 | Rehkemper et al. | 463/1 |
| 2006/0247048 | A1 * | 11/2006 | Mitchell et al. | 463/37 |
| 2007/0021198 | A1 | 1/2007 | Muir et al. | 463/29 |
| 2007/0054739 | A1 | 3/2007 | Amaitis et al. | 463/42 |
| 2007/0060305 | A1 | 3/2007 | Amaitis et al. | 463/25 |
| 2007/0060306 | A1 | 3/2007 | Amaitis et al. | 463/25 |
| 2007/0060355 | A1 | 3/2007 | Amaitis et al. | 463/40 |
| 2007/0060358 | A1 | 3/2007 | Amaitis et al. | 463/42 |
| 2007/0066401 | A1 | 3/2007 | Amaitis et al. | 463/42 |
| 2007/0066402 | A1 | 3/2007 | Amaitis et al. | 463/42 |
| 2008/0248865 | A1 * | 10/2008 | Tedesco et al. | 463/25 |

FOREIGN PATENT DOCUMENTS

| | | | | |
|---|---|---|---|---|
| WO | WO2005035086 | A1 | 4/2005 | A63F 13/12 |
| WO | WO2005086399 | A1 | 9/2005 | H04J 11/00 |
| WO | WO2007008713 | A2 | 1/2007 | A63F 13/00 |
| WO | WO2007022256 | A2 | 2/2007 | A63F 9/24 |

OTHER PUBLICATIONS

PCT Written Opinion of the International Searching Authority for Application No. PCT/US2007/00792 dated Oct. 26, 2007 (4 pages).

* cited by examiner

HANDHELD DEVICE FOR WAGERING GAMES

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines and, more particularly, to handheld wagering games and handheld machines for playing wagering games.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines.

Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

In recent years, handheld electronic devices (e.g., telephones, personal data assistances (PDAs), handheld computers, handheld gaming machines, etc.) have become ubiquitous. These handheld devices advantageously permit the user to interact with the device at a time and place of the user's choosing, rather than requiring the user to be immobile at a fixed point (e.g., a fixed telephone, a desktop computer, a television-based or CRT monitor-based gaming device). A need exists to improve the playability and appeal of conventional wagering games by rendering such wagering games mobile through an appropriate portable electronic wagering game interface in accord with the present concepts.

According to one aspect of the present invention, a gaming system for playing a wagering game on a handheld gaming machine includes a handheld gaming machine configured to play a wagering game and an external system configured to regulate wagering game play on the handheld gaming machine.

According to another aspect of the invention, a handheld wagering game machine includes a controller, a display, at least one player input device to permit input of a command to the handheld wagering game machine by a player, and a communication device. The communication device is configured to permit communication between the handheld wagering game machine and an external system such as, but not limited to, a gaming network, another gaming machine, a gaming server, a communication system, a controller, or a service.

According to yet another aspect of the invention, a method of conducting a wagering game on a handheld wagering game machine includes determining a random outcome for a wagering game and conducting a wagering game on the handheld wagering game machine, the act of conducting including displaying a result associated with the random outcome.

Additional aspects of the invention will be apparent to those of ordinary skill in the art in view of the detailed description of various embodiments, which is made with reference to the drawings, a brief description of which is provided below.

DETAILED DESCRIPTION

Figure 1:
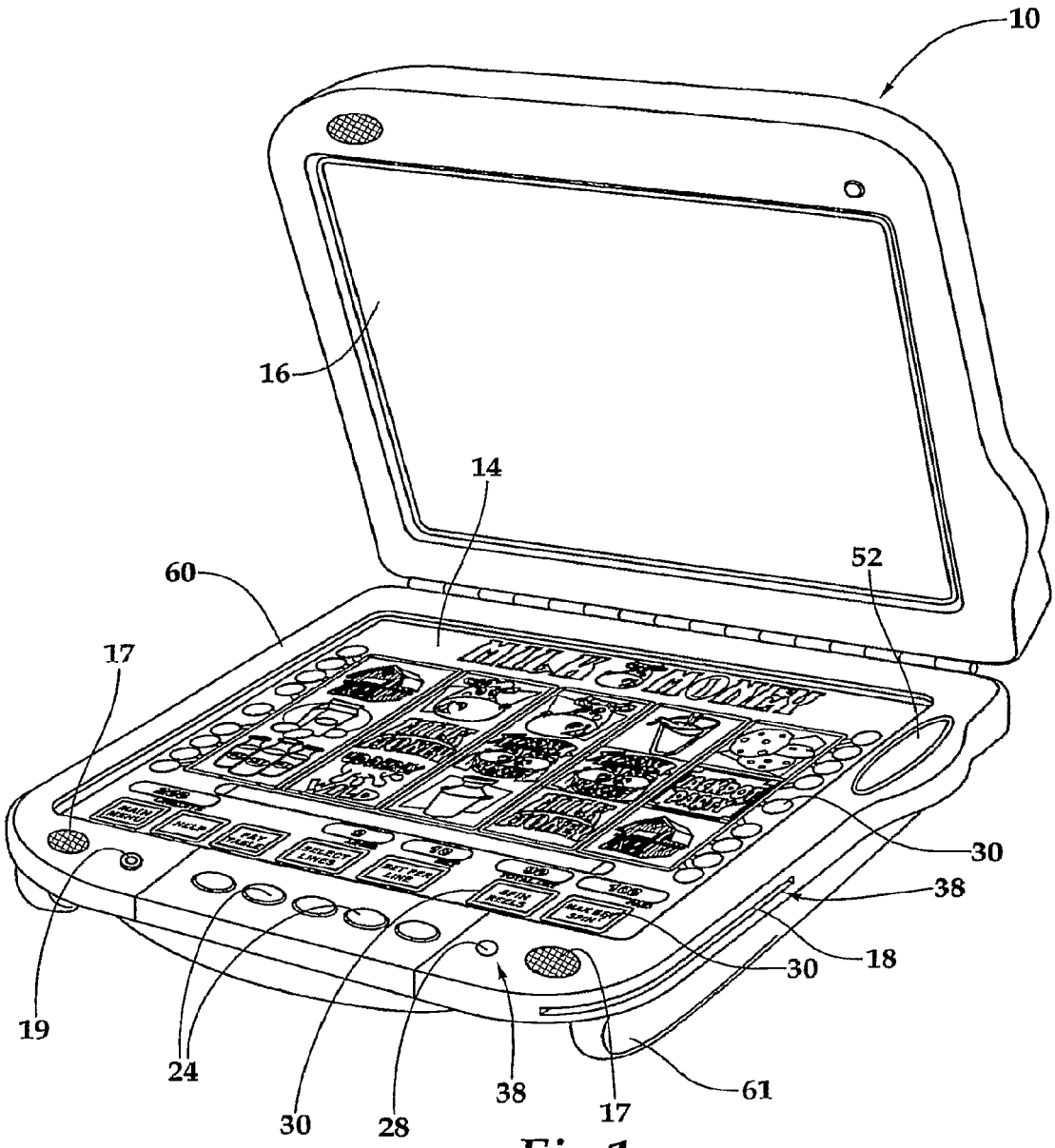
FIG. 1 is a perspective view of a handheld gaming machine in accord with at least some aspects of the present concepts.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a handheld gaming machine 10 is used in gaming establishments such as, but not limited to, casinos. With regard to the present invention, the handheld gaming machine 10 may be any type of handheld gaming machine and may have varying structures and methods of operation. The handheld gaming machine 10 is preferably an electronic gaming machine configured to play a video casino game such as, but not limited to, blackjack, slots, keno, poker, blackjack, and roulette.

The handheld gaming machine 10 comprises a casing 60 and includes input devices, including a value input device 18 and a player input device 24. For output the handheld gaming machine 10 includes, but is not limited to, a primary display 14, a secondary display 16, one or more speakers 17, one or more player-accessible ports 19 (e.g., an audio output jack for headphones, a video headset jack, etc.), and other conventional I/O devices and ports, which may or may not be player-accessible. In the embodiment depicted in FIG. 1, the gaming machine 10 comprises a secondary display 16 that is rotatable relative to the primary display 14. The optional secondary display 16 may be fixed, movable, and/or detachable/attachable relative to the primary display 14. Either the primary display 14 and/or secondary display 16 may be configured to display any aspect of a video game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

While these typical components found in the handheld gaming machine 10 are described below, it should be understood that numerous other elements may exist and may be used in any number of combinations to create various forms of a handheld gaming machine 10.

An optional player-accessible value input device 18 may be provided in the handheld gaming machine 10. In one aspect, the player-accessible value input device 18 may comprise, for example, a slot located on the front, side, or top of the casing 60 configured to receive credit from a stored-value card (e.g., casino card, smart card, debit card, credit card, etc.) inserted by a player. In another aspect, the player-accessible value input device 18 may comprise a sensor (e.g., an RF sensor) configured to sense a signal (e.g., an RF signal) output by a transmitter (e.g., an RF transmitter) carried by a player. The player-accessible value input device 18 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 10.

Still other player-accessible value input devices 38 may comprise a touch-screen display (e.g., primary display 14 and/or secondary display 16), player input devices 24, or touch keys 30. Upon entry of player identification information and, preferably, secondary authorization information (e.g., a password, PIN number, stored value card number, predefined key sequences, etc.), the player may be permitted to access a player's account. As one potential optional security feature, the handheld gaming machine 10 may be configured to permit a player to only access an account the player has specifically set up for the handheld gaming machine. Other conventional security features may also be utilized to, for example, prevent unauthorized access to a player's account, to minimize an impact of any unauthorized access to a player's account, or to the prevent unauthorized access to any personal information or funds temporarily stored on a handheld gaming machine 10.

The player-accessible value input device 38 may itself comprise or utilize a biometric player information reader which permits the player to access available funds on a player's account, either alone or in combination with another of the aforementioned player-accessible value input devices (e.g., 18, 28). In an embodiment wherein the player-accessible value input device 38 comprises a biometric player information reader, transactions such as an input of value to the handheld device, a transfer of value from one player account or source to an account associated with the handheld gaming machine 10, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 38 comprising a biometric player information reader may require a confirmatory entry from another biometric player information reader 52, or from another source, such as a credit card, debit card, player ID card, fob key, PIN number, password, hotel room key, etc. Thus, a transaction may be enabled by, for example, a combination of the personal identification input (e.g. biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds.

Figure 5:
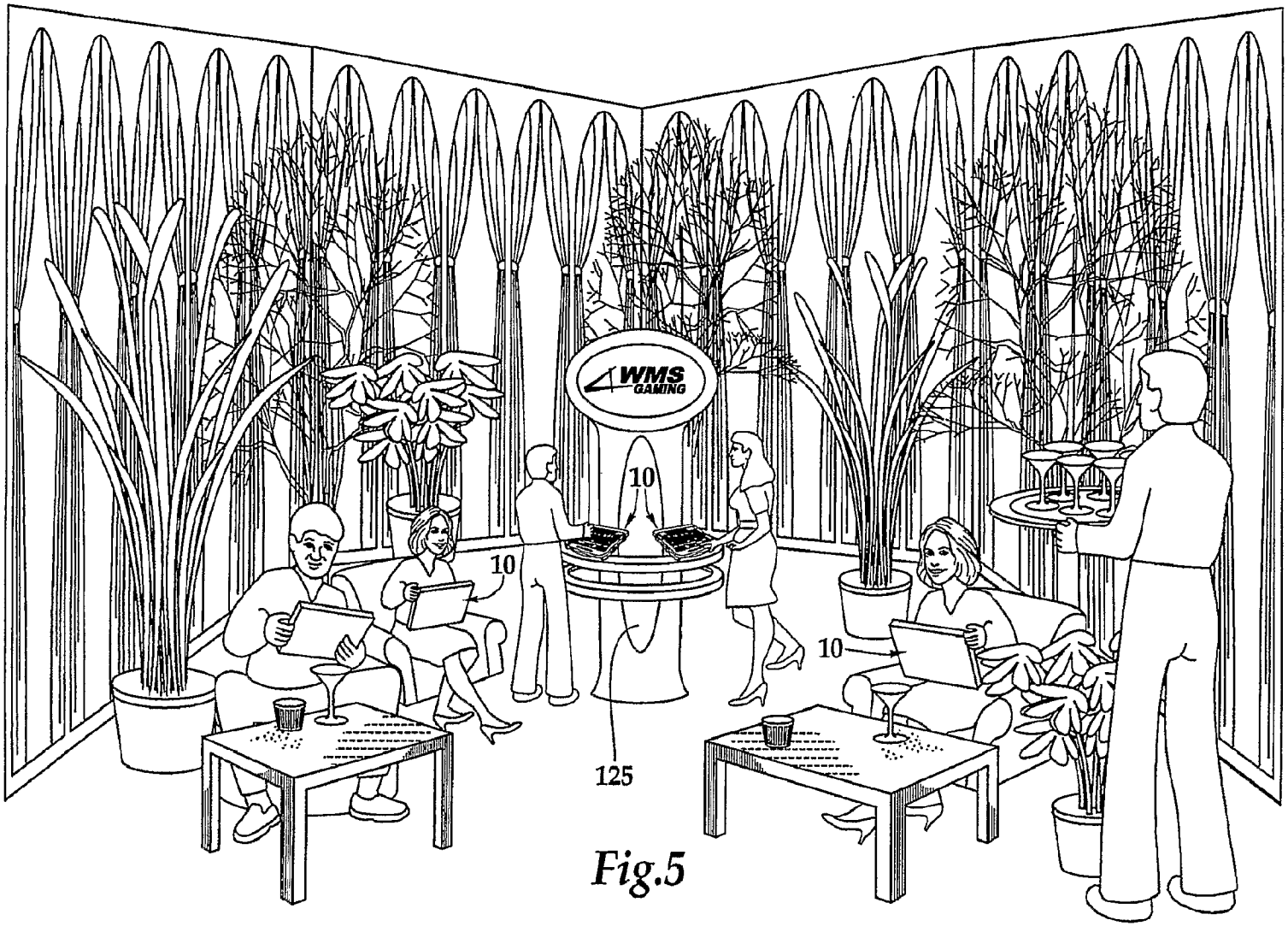
FIG. 5 illustrates a concept of a handheld gaming machine lounge and kiosk in accord with at least some aspects of the present concepts.

In another aspect, the value input device 18 may be provided remotely from the handheld gaming machine 10. For example, the handheld gaming machine 10 may be stored, when not used, in a kiosk or in a booth 125 (see FIG. 5), which may be optionally staffed by an attendant. The value input device 18 may thus reside within the kiosk or booth 125 and a value may be input by the player, or by an attendant, and assigned to a selected one of the available handheld gaming machines 10. The assigning of a value, or a minimum specified value (e.g., $50, $100, $200, $500, etc.), to a handheld gaming machine 10 may comprise an optional pre-condition to release or checkout of the handheld gaming machine.

When the player obtains or checks out the handheld gaming machine 10 through a kiosk 125 or through a gaming establishment employee (e.g., a cashier or handheld gaming machine attendant), the player may be prompted to transfer money into an account, which will be associated with the handheld gaming machine 10 assigned to the player and/or to the player or player identifying information. For example, the kiosk 125 may be provided with a player-accessible value input device such as, but not limited to, a magnetic card-reading or magnetic card-reading/writing device, an RF sensor/transmitter or other type of electromagnetic signal communication and storage device, a bill accepter, a change acceptor, or the like. The player-accessible value input device could also or alternatively comprise a display, such as a touch screen display, wherein a player may enter information (e.g., player ID number, PIN number, room number, code word, etc.) sufficient to identify the player to permit the player to, for example, transfer or associate finds from a pre-existing account to the subsequent wagering activities on the assigned handheld gaming machine 10. The account may be established on a gaming establishment server, storage device, service, or the like, and/or locally on the handheld gaming machine 10.

Once an initial account is set up for the handheld gaming machine 10 or an existing account associated with the handheld gaming machine, subsequent inputs of value or transfers of finds may be permitted using a handheld gaming machine player-accessible value input device 18, if provided, or using another of the above-noted value input devices (e.g., kiosk, handheld gaming machine attendant, cashier, designated docking port, etc.). For example, when a player needs to replenish an account from which his or her handheld gaming machine 10 is drawing upon, the player may input additional funds by using a value input device at a kiosk 125 serving the handheld gaming machines, an authorized docking port (e.g., at a bar), or by transferring money to the player's handheld gaming machine account using a gaming establishment cashier or handheld gaming machine attendant.

The player input device 24 comprises a plurality of push buttons 26 on a button panel for operating the handheld gaming machine 10. In addition, or alternatively, the player input device 24 may comprise a primary display 14 and/or secondary display 16 that is a touch screen. In one aspect, the touch screens are matched to a display screen having one or more selectable touch keys 30 selectable by a user's touching of the associated area of the screen using a finger or a tool, such as a stylus pointer. A player enables a desired function either by touching the touch screen at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the handheld gaming machine 10 may be connected directly to, or contained within, the casing 60, as seen in FIG. 1, or may be located outboard of the casing 60 and connected to the casing via a variety of hard-wired (tethered) or wireless connection methods. For example, a push button panel comprising push buttons 26 may be provided separately from the handheld gaming machine 10 (or attachable/detachable from a display-unit portion of the handheld gaming machine) and may be wirelessly coupled to the handheld gaming machine. In this configuration, the player may set the handheld gaming machine down so as to face the player (e.g., on a table or coffee table) and may play the game through the handheld button panel. This configuration could, for example, minimize the weight held in the players hands, permit the player to assume a more comfortable position, and even permit the player to charge the display-unit portion of the handheld gaming machine while docketed at designated docking port. Thus, the handheld gaming machine 10 may comprise a single unit or a plurality of interconnected parts (e.g., wireless connections) which may be arranged to suit a player's preferences.

The operation of the basic wagering game is displayed to the player on the primary display 14. The primary display 14 can also display the bonus game associated with the basic wagering game. The primary display 14 preferably takes the form of a high resolution LCD, a plasma display, an LED, or any other type of display suitable for use in the handheld gaming machine 10. The size of the primary display 14 may vary from, for example, about a 2-3" display to a 15" or 17" display. In at least some aspects, the primary display 14 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). The primary display 14 may also optionally comprise a touch screen to permit players to make game-related selections using the primary display.

In at least some embodiments, the primary display 14 and/or secondary display 16 may have a 16:9 aspect ratio or other aspect ratio (e.g., 4:3). The primary display 14 and/or secondary display 16 may also each have different resolutions, different color schemes, and different aspect ratios.

The primary display 14 and/or secondary display 16 of the handheld gaming machine 10 may, in some aspects, comprise a haptic display, such as those haptic displays (e.g., Touchsense®) manufactured by Immersion Corporation of San Jose, Calif. When the user of the handheld gaming machine 10 touches a touch screen key 30 of a haptic touch screen display (e.g., primary display 14), the touch screen key will convey the sense of being depressed and released through the use of vibrations transmitted through the screen to the user's finger. The use of a haptic display advantageously provides sensory feedback to the user of the handheld gaming machine 10 as confirmation of a user's action or selection.

A player begins play of the basic wagering game by making a wager (e.g., via the value input device 18 or an assignment of credits stored on the handheld gaming machine via the touch screen keys 30, player input device 24, or buttons 26) on the handheld gaming machine 10. In at least some aspects, the basic game may comprise of a plurality of symbols arranged in an array, and includes at least one payline 32 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 18 of the handheld gaming machine 10 or kiosk 125 may double as a player information reader that allows for identification of a player by reading a card with information indicating the player's identity (e.g., reading a player's credit card, player ID card, smart card, etc.). A player information reader may alternatively or also comprise a bar code scanner, RFID transceiver or computer readable storage medium interface. In one presently preferred aspect, the player information reader 52, shown by way of example in FIG. 1, comprises a biometric sensing device.

Personal information or identification is used by casinos for rewarding certain players with complimentary services or special offers. For example, a player may be enrolled in the gaming establishment's loyalty club and may be awarded certain complimentary services as that player collects points in his or her player-tracking account. The player may, for example, insert his or her card into a card-based player information reader 52 or press his or her finger against a biometric-based player information reader 52, which allows the casino's computers to register that player's wagering at the handheld gaming machine 10. The handheld gaming machine 10 may use the primary display 14, the secondary display 16 or other dedicated player-tracking display for providing the player with information about his or her account or other player-specific information. Also, in at least some embodiments, the information reader 52 may be used to restore game assets that the player achieved and saved during a previous game session.

Figure 2:
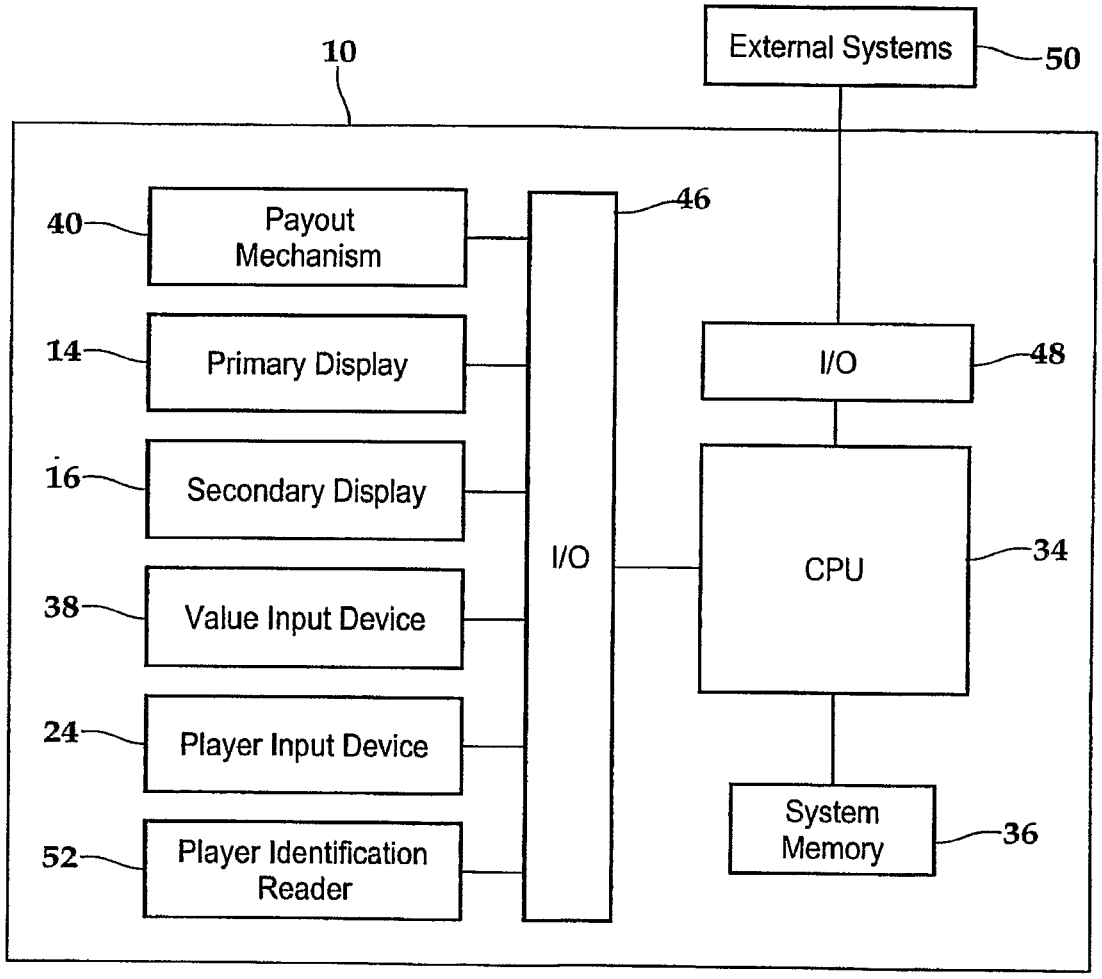
FIG. 2 is a block diagram of a control system suitable for operating handheld gaming machines utilized in accord with the present concepts.

Turning now to FIG. 2, the various components of the handheld gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a player-accessible value input device 38. In at least some aspects, the player-accessible value input device 38 comprises a slot 18 (FIG. 1) into which a magnetic card, such as a credit card or debit card, may be at least partially inserted and the transaction processed in combination with the I/O 48 and communication of data associated with the magnetic card to appropriate external systems 50 (e.g., to conduct a money transfer, to charge to a credit line, etc.). In still other aspects, the player-accessible value input device 38 may be integrated with the player identification reader 52 and the player may be provided a predetermined amount with which he or she may gamble. For example, a player may have already established a line of credit with the gaming establishment or access and may accordingly be permitted to draw upon this line of credit or a player may have pre-purchased credits from the gaming establishment. In still other aspects, the player-accessible value input device 38 may comprise a magnetic sensor and/or receiver 28 (FIG. 1), or other type of sensor and/or receiver, configured to receive information from a corresponding key, insert, transmitter or emissive device (e.g., an insertable key fob or RFID key fob containing a chip and an antenna which may be interrogated by the handheld gaming machine 10). In one example, the gaming establishment may exchange for currency a key fob which the player may then insert into or place adjacent a correspondingly configured sensor and/or receiver 28.

In at least some embodiments, the player-accessible value input device 38 and/or external systems 50 may provide an enabling signal to the processor to permit continued play of the handheld gaming machine 10 and continued access to other non-game-play related features provided a certain minimum level or credits or electronic coin-in is maintained. The player-accessible value input device(s), as noted herein, may also be provided externally to the handheld gaming machine 10 on a kiosk 125, handheld gaming machine attendant station, or the like. Still further, in at least some other embodiments, the player may not be permitted to add value to the handheld gaming machine 10 and the player must return the handheld gaming machine to an authorized handheld gaming device attendant and/or docking station or kiosk 125 to add value to the handheld gaming machine. The handheld gaming machine 10 may even be configured to receive large denomination currency.

The system memory 36 may comprise a volatile memory (e.g., a random-access memory (RAM)) and a non-volatile memory (e.g., an EEPROM). The system memory 36 may include multiple RAM and multiple program memories.

As seen in FIG. 2, the controller 34 is also connected to, and controls, the primary display 14, the player input device 24, and a payout mechanism 40. The payout mechanism 40 is operable in response to instructions from the controller 34 to award a payoff to the player in response to certain winning outcomes that might occur in the basic game or the bonus game(s). The payoff may be provided in the form of points, credits, tickets, smartcards, coupons, etcetera. For example, in FIG. 2, the payout mechanism 40 may comprise a dedicated wireless output device (e.g., a wireless transmitter), port, or on-board storage device(s). The payout mechanism 40 may comprise, for example, redundant storage devices, that may be written to and accessed only by an authorized system and/or employee (e.g., electronically-coded and/or physically-controlled access). Redundancy may provide a mechanism for both back-up, in the event of an equipment failure, as well as security (e.g., comparisons may be made between the redundant storage device memories and times of updates). As a memory device, the payout mechanism 40 may comprise a portion of system memory 36 or may comprise one or more separate memory devices. The payout mechanism 40 may be connected to I/O 48 and may output information to external systems 50 through a wireless link or through a direct connection (e.g., through a kiosk 125 port) for storage and/or processing. For example, the payoff may be directly deposited into an account designated by the player when the handheld gaming machine 10 is undocked or checked out (e.g., to a personal bank account, credit card, or casino account) or to an account designated by a player's loyalty club card or player's card (i.e., into an account maintained for the player by the casino).

In at least one aspect, the payout mechanism communicates periodically (e.g., every play, every second, etc.) to update a central account. Upon completion of wagering game play, the player may check in his or her handheld gaming machine 10 and receive winnings from a cashier upon verification to the player's identity and/or account. In another aspect, when a player checks in his or her handheld gaming machine 10 at a kiosk 125 or other designated location, the winnings or funds stored on the payout mechanism 40 and/or system memory 36 may be automatically credited to an account designated by the player. The account may be predesignated account selected by the player (e.g., a thief would be unable to transfer funds from a stolen handheld gaming machine 10 to an account other than that previously designated by the player to whom the handheld gaming machine was assigned). The winnings associated with any particular winning combination are displayed to the player on the primary display 14 and/or secondary display 16 in accord with one or more pay tables stored in the system memory 36 and a tally of winnings is also preferably displayed.

Communications between the controller 34 and peripheral systems (e.g. 12, 16, 24, 38, 40, 52) and external systems 50 occur through input/output (I/O) circuits 46, 48. More specifically, the controller 34 controls and receives inputs from the peripheral components and systems of the gaming machine 10 through the input/output circuits 46. Further, the controller 34 communicates with the external systems 50 via the I/O circuit(s) 48 and a communication path (e.g., serial, parallel, IR, RC/RF, 10 bT, etc.). In at least some embodiments, the communication path between I/O 48 and the external systems 50 comprise a hard-wired or a wireless communication path, such as, but not limited to Bluetooth®, WiFi, broadband wireless, or other wireless communication path. In one example of a wireless gaming environment, a short-range radio-frequency communication path including measures to avoid signal interference, such as by utilizing spread-spectrum frequency hopping, may be provided in an intimate, upscale gaming lounge, such as in represented by the gaming lounge illustrated in FIG. 5. In this example, Bluetooth®-enabled speakers could be provided at the bar, at or around individual seats in a lounge area, and/or even at lounge chairs by a pool, so that when a person with a handheld gaming machine 10 sits down near one of the Bluetooth®-enabled speakers, the audio of the game is broadcast, at a reasonably discrete sound level, from the adjacent Bluetooth®-enabled speakers. Certain events, such as a big win, could be broadcast at relatively higher sound levels. Of course, any wireless communication path may be utilized to permit connection between the handheld gaming machine 10 and the external systems 50 (e.g., short-range optical coupling).

In another aspect of the present concepts, the primary display 14 or the secondary display 16 could comprise a wearable display (e.g., a heads-up display), such as those made by Cybermind Interactive Nederland of the Netherlands (e.g., Visette 45 SXGA or Hi-Res 800), eMagin of Washington (e.g., Z800 3D visor), Icuiti of New York (e.g. V920), i-O Display Systems of Sacramento, Calif. (e.g., i-Theatre, i-glasses video, i-glasses video 3-D pro, i-glasses PC/SVGA, i-glasses PC/SVGA Pro 3D), or Leadtek of Taiwan (e.g., X-Eye (2D video)), NVIS of Reston, Va. (e.g., nVisor ST, nVisor SX), Olympus of Japan (e.g., head mount display HMD)).

Wearable displays are not limited to these manufacturers or the noted examples. It would be advantageous, but not necessary, for a wearable display utilized in concert with the handheld gaming machine 10 to be partially or wholly see-through so as to permit the wearer to easily navigate, move around, or interact with other people while wearing the wearable display. The wearable display could comprise, for example, a 2-panel (i.e., 2-eye) display or a 1-panel (i.e., 2-eye or 1-eye) display. For example, the Mitsubishi SCOPO, like a number of other wearable displays, disposes a small LCD screen in front of and slightly below the user's eyes to provide the illusion of a 10" screen so as not to obstruct the user's field of vision. Unlike a handheld gaming machine 10 having a large, tablet-like display 14, a wearable display provides an added measure of privacy, which may be particularly advantageous to particular players or in particular gaming environments (e.g., a card game tournament or other type of competitive-play environment wherein a player does not want other players or spectators to see the player's cards).

If the primary and/or second displays 14, 16 are relegated to a wearable display, the remainder of the handheld gaming machine 10 may be further streamlined to a minimalist data input device such as, but not limited to, a bar or shaped-object having a plurality of push buttons distributed thereabout. The handheld gaming machine 10 could comprise a narrow secondary display sufficient to describe a function of each of the push buttons 26 provided on the handheld gaming machine. In still another aspect, the handheld gaming machine 10 could comprise a narrow secondary display 16 having touch screen keys 30 provided thereon. In still other aspects, the handheld gaming machine 10 user interface could, in combination with a wearable display, comprise a wearable input device which could include a joystick, cursor control buttons, mouse, a slide selection switch, a rotatable wheel and button combination (e.g., like the Apple IPOD® or the RIM BlackBerry®). Such devices may optionally be wirelessly connected or coupled to one another (e.g., Bluetooth®-enabled) to permit the input devices and wearable display to operate synchronously and with one another without wires.

Another adaptation of the present concepts would be to use a wearable display, such as noted above, and utilize a microphone as a player input device 24. One or more microphones are typically integrated into the above-noted wearable displays. Due to the minimal and known set of commands which would need to be recognized by the handheld wagering game, conventional speech-recognition systems could quickly be trained to recognize these limited numbers of commands, even for persons with unusual accents or speaking difficulties. The speech-recognition could be supplemented by vocal prompts through a headset, typically integrated with the wearable displays, verifying that the action to be taken is the desired action.

The external systems 50 may include a gaming network, other gaming machines, a gaming server, communications hardware (and/or software and/or firmware), a controller, a service, or a variety of other interfaced systems or components (e.g., wireless speakers, lighting). Although the I/O circuits 46, 48 are each shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the handheld gaming machine 10 that may communicate with and/or control the transfer of data between the handheld gaming machine 10 and a bus, another computer, processor, or device and/or a service and/or a network. The controller 34 may comprise one or more controllers or processors. In FIG. 2, the controller 34 in the handheld gaming machine 10 is depicted as comprising a CPU, but the controller 34 may alternatively comprise a CPU in combination with other components, such as the I/O circuits 46, 48 and the system memory 36.

In some embodiments, the handheld gaming machine 10 may be dedicated to a specific wagering game application and variability of the user interface is not of concern. However, in at least some embodiments of a handheld gaming machine 10 in accord with the present concepts, the user interface of the handheld gaming machine 10 is preferably adaptable to support a variety of wagering game platforms, such as is described in the examples herein.

To support a variety of wagering game platforms, the player input device 24, particularly the plurality of push buttons 26, may be assignable or programmable. In still other aspects of the present concepts, the push buttons 26 may comprise flush soft-touch pads, rather than buttons, or the push buttons 26 may be entirely eliminated in favor of touch screen keys 30 to streamline the surfaces and look of the handheld gaming machine 10. Whether the player inputs 24 are push buttons 26 or touch screen keys, the function of each button may be individually assigned to correspond to a predetermined game, a predetermined point of play during a game, and/or a user's preferences. Also, a push button 26 may be assigned multiple functions with the desired function selected through the optional use of a "shift" key or a scrolling member. The handheld gaming machine 10 may thus permit each user to individually configure the user interface to suit the user's individual preferences.

In other respects, the handheld gaming machine 10 may comprise, further to, or in lieu of, push buttons 26, a scrolling ball, a scrolling wheel, and/or touch keys configured to facilitate a user's inputs. A scrolling ball can be used to perform functions related to a wagering game including, but not limited to, functions related to navigating between options on a gaming menu. For example, the player can use the scrolling ball to navigate between a plurality of playable games on the display device when searching for a game. The scrolling ball can have a free-spin mode (also referred to as hyperfast scrolling) in which the player can rapidly navigate between a large number of options (e.g., hundreds of games). Optionally, the scrolling ball can have a click-to-click mode in which the player can precisely navigate from one option to a subsequent option. The player can switch between the free-spin mode and the click-to-click mode automatically. For example, the scrolling ball can include a sensor that detects the scroll speed and automatically switch between the two modes when a predetermined speed threshold is reached. Optionally, the player can press a button (such as a touch key) to manually switch between the two modes.

The functions of the scrolling ball allow the player to navigate a menu of options in a fast and accurate manner. For example, the player is provided with a menu having thousands of game that can be selected for playing. The player can use the scrolling ball to rapidly navigate through the first few hundred games. However, when the player notices a game of interest, he or she can slow down the navigation and precisely select the game of interest. Other functions can be related to redeeming points, selecting bonus rounds, viewing previously played games, providing input during a game, etc.

The scrolling ball is, in at least some aspects, located on a top surface of the handheld gaming machine 10, near a left bottom corner, right bottom corner, or in any other desired location. The location of the scrolling ball is preferably selected such that the player can operate the scrolling ball and hold the handheld gaming machine 10 with one hand. For example, the player can hold the handheld gaming machine 10 with his or her left hand such that the player's left thumb can be used to operate the scrolling ball. Thus, the player has the right hand available for other functions (e.g., answer a mobile phone, input a selection on a touch display, input a wager, etc.).

The handheld gaming machine 10 may comprise a scrolling wheel, alone or in combination with the scrolling ball and/or any other input devices. The scrolling wheel may be disposed in an orientation perpendicular to the casing 60 (e.g., as in a BlackBerry device), parallel to the casing (e.g., as in an IPOD), or at an angle therebetween. In one aspects, the scrolling wheel may be provided opposite the scrolling ball, so that the player can operate the scrolling ball with one hand and the scrolling wheel with the other hand. In alternative aspects, two scrolling balls or scrolling wheels may be provided in opposition to one another (e.g., a scrolling ball on the left said and a scrolling ball on the right side). The scrolling wheel can perform one or more of the same functions as the scrolling ball and/or push button (e.g., the scrolling wheel may be depressed, as a push button). Thus, if the scrolling wheel(s) and/or the scrolling ball(s) have the same functions, the remote input device can be, in general, used by either a left-handed or right-handed person.

According to alternative embodiments, only one of the scrolling wheel and the scrolling ball is located on the handheld gaming machine 10. The location of the scrolling wheel and the scrolling ball can be located anywhere on the handheld gaming machine 10 to allow the player to one-handedly hold the handheld gaming machine and operate the respective scrolling wheel or the scrolling ball. For example, either one of the scrolling ball and/or the scrolling wheel can be located on a bottom surface of the remote input device or on a side surface such that the player can use any finger for operating the scrolling ball or the scrolling wheel. Thus, where the scrolling ball and/or the scrolling wheel is disposed on a rear of the handheld gaming machine 10 (e.g., toward the left or right side near a gripping area or on the back of a handheld gaming machine handle), the player may use an index finger or middle finger, for example, to manipulate a scrolling ball or scrolling wheel while securely grasping the handheld gaming machine with the remaining fingers. A plurality of such scrolling balls or scrolling wheels may be provided in different locations to suit different player's preferences and/or to mitigate fatigue arising from repetitive use of the same finger (s) during play.

In at least some aspects, the aforementioned scrolling wheel, scrolling ball, or any other input devices may be separately provided on a remote control, which may optionally be removably integrated with, or attached to, the handheld gaming machine 10 when not in use.

In accord with the above-described scrolling wheel, scrolling ball, touch keys, or other input device(s) such as, but not limited to, touch screen keys, selections within games (e.g., picking bonus rounds) and navigation, in general, is enhanced.

To facilitate instant recognition of "active" keys or "inactive keys," the push buttons 26 and/or touch screen keys 30 may be highlighted, back lit, configured to transmit colored light (e.g., green, red), de-energized (i.e., no light), or at least partially circumscribed by a light to differentiate the active keys from the inactive keys. For example, for a picking game like Jackpot Party®, where a selection is to be made using the push buttons 26 or touch screen keys 30, the buttons or keys which are available for selection may be lit, while the buttons or keys which are not available for selection may be dark, dimmed, or colored (e.g., red light means the selection is not available, green light means the selection is available).

In at least some embodiments, the push buttons 26 may be integrated into a removable, rather than a fixed, button panel. Thus, the casino or gaming establishment could easily physically configure and/or reconfigure the handheld gaming machine 10 with any one of a plurality of button panels to change the player inputs and/or to accommodate different games to be played on the handheld gaming machine. In one aspect, the button panel having push buttons 26 could be removed and a player input comprising a different button panel, or even a joystick bearing one or more buttons or triggers, could be substituted in its place. The functionality or interaction between the user and the game may further be enhanced by utilizing the I/O connectors and physical connecting members (e.g., male/female attachment members) for the removable button panel to accommodate not only other button panels, but entirely different add-on devices and consoles.

In still additional embodiments of the present concepts, the push buttons 26 may be integrated into a movable button panel. Thus, the user could easily physically configure the handheld gaming machine 10 to present a button panel corresponding to a desired wagering game. For example, a 4-sided button panel rotatable about a longitudinal or lengthwise axis may have a plurality of push buttons 26 disposed on each side. In one embodiment, each side of the button panel could be color coded to correspond to an associated one of the wagering games. For example, if a blue background game is displayed, you need to use a blue button panel. For a handheld gaming machine 10 configured to play a slot machine game, a user could unlock the button panel and rotate the movable button panel through a predetermined rotation (e.g., 90°, 180°, 270°) to present a set of push buttons 26 corresponding to a poker game to be played. It would be preferred that all buttons that are not in a home position (i.e., presented to the player) would be automatically deactivated. The functionality of each of the push buttons 26 could be displayed on the button panel adjacent the buttons or could be displayed on the primary or secondary display 14, 16, as applicable, adjacent the respective push buttons.

For handheld gaming machines 10 which are configured to play a plurality of different wagering games, it is preferred that a selection of a wagering game for play would automatically enable and display touch screen keys 30 appropriate to the game or would automatically assign appropriate functions to each of the push buttons 26 with an appropriate legend, key, or information displayed on the primary and/or secondary display to inform the user as to the assigned functionality for each of the push buttons. The touch screen keys 30 may also be customizable such that the user may be permitted to alter a color screen or visual appearance of the touch screen keys (e.g., a modem look, a high-tech look, an antique look, a cartoonish look, etc.) and/or the location of the touch screen keys (e.g., drag and drop of keys or bar). In another aspect, the user may be permitted to select from one of a plurality of touch screen key configurations (e.g., one of five or one of ten including, for example, a right hand version, a left hand version, a dual thumb version, a distributed version, a center version, etc.). Moreover, to minimize muscle fatigue and/or joint stiffness, the handheld gaming machine 10 may automatically cycle through a plurality of different touch screen key configurations or push button assignments (with appropriate notice) so that the user does not engage in exactly the same repetitions of motion for extended periods of time.

It at least some aspects of the present concepts, it is desired to provide a conventional display (e.g., LCD, plasma) with push button 26 player inputs 24. For example, for some types of games, such as picking games, keno, and bingo, a touch-screen may be sufficiently advantageous to game play to justify the added cost of that type of user interface. However, in other games, such as many card-based games (e.g., black-jack and poker variants), a touch screen is not necessary and may be omitted to reduce the overall cost of the handheld gaming machines 10 directed toward such games. As noted above, player input devices 24 might utilize features other than buttons, including rolling members (e.g., balls, wheels) configured to control the movement of a cursor or trigger-like buttons disposed in ergonomically-accessible positions.

In various aspects, the push button panel, if provided, may be hidden or covered by the player if not in use. For example, for the rotatable configuration of movable button panel described above, one or more of the movable button panel positions may comprise a surface having no buttons. In another aspect, the button panel may be covered by one or more slidable members to selectively expose portions of the button panel. In yet another aspect, the button panel could be a pop-out, spring-loaded member that could be ejected into a protruding position or inserted into a stowed position in accord with the desire of the user. In still another aspect, the primary display 14 may be hinged to permit 180° rotation about the base 61 such that the button panel is disposed at a bottom of the machine. The handheld gaming machine 10 may be configured to deactivate the button panel when the display is in this position (e.g., rotated past 175°) so that the player can use the display as a touch pad without needing to interact using the push buttons 26.

To avoid erroneous or unintended inputs through the touch screen, the primary display 14 and/or secondary display 16 may comprise a haptic display, as noted above, so that the user is immediately made aware of an input. Moreover, for a haptic display or a regular touchscreen display, the timing of the input could be adjusted to distinguish a deliberate activation of the button or key (e.g., a 2-second push) or an inadvertent or questionable activation (e.g., a 0.10 second push). For buttons 26, a piezoelectric element could also be used to selectively retard the motion of the buttons 26 or to increase a resistance of certain buttons against inadvertent activation. In still another configuration, certain buttons or functions might be interlocked and require enablement by pushing another button or taking another action. For example, a spin or play button could be placed on each of the left and right sides of the handheld gaming machine 10, such as on the case or body 12 of the device or on handles connected thereto, and activation of each spin or play could require a simultaneous push of both of the left and right spin or play buttons.

Again, the handheld gaming machine 10 may comprise a primary display 14 and an optional secondary display 16. The primary and secondary displays 14, 16 may be movable about one or more axes relative to the base 61 of the handheld gaming machine 10, the casing 60, and/or relative to each other. For example, the primary display 14 may be hinged to the base 61 of the handheld gaming machine 10. The secondary display 16, where provided, may be fixed to the casing 60 bearing the primary display 14, hinged to the casing of the handheld gaming machine in a position that does not interfere with the hinge or movement of the primary display, or may be hinged directly to the primary display. The primary and secondary displays 14, 16 may share the same hinge so as to permit the displays to be folded against one another and provide a compact package or folded out to provide side-by-side dual displays. A common hinge disposed at a top edge of the primary display 14 would also permit a player to view the primary display and rotate the secondary display 16 to face another person sitting across from the player. For example, with the screen positioned as noted above, and locked in place, the player inputs 24 and wagering game could be configured to permit "head-to-head" game play using a single handheld gaming machine with player inputs for multiple players.

Alternatively, a handheld gaming machine 10 in accord with the present concepts could comprise a separable primary display 14 and secondary display 16, each of the primary display and secondary display comprising a player input device 24 (e.g., push buttons 26, touch screen keys 30, etc.). Each of the primary display 14 and secondary display 16 could individually be wirelessly connected to the controller 34 (e.g., a Bluetooth®-enabled communication path). In this configuration, two players could play a wireless "head to head" game using a single handheld gaming machine 10 separated into two parts. The handheld gaming machine bearing the primary display 14 could, for example, control the wagering game and output appropriate data bearing carrier signals to an I/O port of the secondary display 16 for processing by an on-board controller. The primary display 14 and secondary display 16 could alternatively be hard-wired to one another using a flexible connection (e.g., extendable) to permit close proximity "head to head" game using a single handheld gaming machine 10 separated into two parts The secondary display 16, where provided, may serve functions separate to those of supporting the wagering games played upon the handheld gaming machine 10. For example, the secondary display could present one or more real-time or slightly-delayed ticker symbol, the news, or other information of interest to the player (e.g., sports scores, odds, spreads, availability of tickets to performances at the gaming establishment, availability of a dinner reservation, a reminder of a dinner reservation, approaching a milestone of membership in the establishment's player's club, TV-feed, video-feed, etc.). Accordingly, a player may simultaneously play a wagering game on the primary display 14 while receiving, on the secondary display, a feed (e.g., text and/or video) of information (e.g., scores, statistics, status, revised odds, etc.) on one or more on-going sporting events or competitions (e.g., college basketball or football games, etc.).

Figure 6:
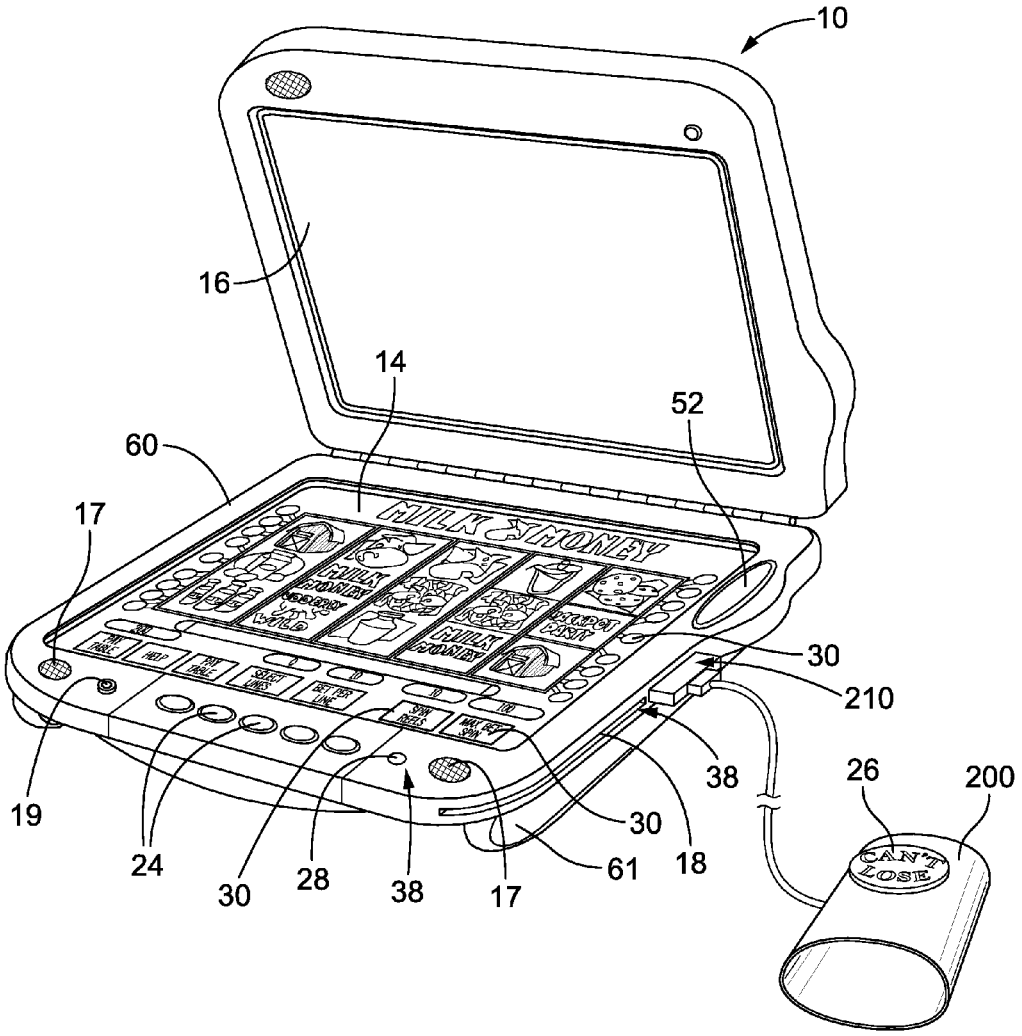
FIG. 6 is a perspective view of a handheld gaming machine connected to an add-on module comprising a specialty push button, according to an embodiment of the present disclosure.

In lieu of a video-based secondary display 16, or in addition thereto, the handheld gaming machine 10 could also include mechanical and/or electrical connectors 210 to support other add-on modules 200 (See, e.g., FIG. 6). In at least some embodiments, the add-on modules 200 could comprise mini-mechanical and/or electro-mechanical features such as, but not limited to, a mechanical wheel, mechanical reel, a small scroll top, or other moving components. The mechanical connectors could comprise any mechanical connector (e.g., snap-together male and female connectors) sufficient to removably affix the add-on module 200 to the handheld gaming machine 10 or portion thereof (e.g., casing 60, base 61, primary display 14, secondary display 16, etc.). The electrical connector could comprise any electrical connector sufficient to permit communication between the handheld gaming machine 10 and the add-on module and/or to permit power to be transferred therebetween (e.g., a USB connection). In one aspect, the add-on module 200 could comprise a power source (e.g., battery) and could communicate with the handheld gaming machine 10 via a wireless connection (e.g., Bluetooth@). In other aspects, the add-on modules 200 could comprise other electronic devices, such as XM or Sirius satellite radio and/or video receivers.

The add-on modules 200 could also comprise special player inputs 24 that could be provided to players meeting pre-determined pre-conditions. For example, the add-on module 200 could comprise a specialty push button 26 providing a pre-determined winning outcome (e.g., a "can't lose button" as shown in FIG. 6) or providing a pre-determined result for one or more aspects of game play (e.g., a wild card), which may or may not produce a winning outcome. Such pre-determined winning outcome or pre-determined result would, preferably, be constrained to some pre-determined number of actuations (e.g., 1, 2, 3, 4, 5, etc.). The pre-determined number of actuations would, in turn, be determined by the nature of the pre-determined pre-conditions satisfied by the player. For example, if a player buys a block play of 100 games, the player might receive an add-on module 200 comprising a specialty push button 26, as noted above, having only one permitted actuation. On the other hand, a player buying a block play of 1000 games might receive an add-on module 200 comprising a specialty push button 26 having ten or twenty actuations. The availability of the add-on module 200 and/or the predetermined number of actuations might further be conditioned upon the level of bets placed by the player.

Alternatively, in lieu of an add-on module, the functionality of the specialty push button 26 could be provided by a touch screen button 30 that could be enabled for a player when the handheld gaming machine 10 is checked out by a player. Still further, for a networked wagering game played on the handheld gaming machine 10, the noted functionality (i.e., the specialty button) could be stored for access by the networked wagering game in association with the player (i.e., via a player identification reader 52 input) and/or handheld gaming machine ID.

In one aspect, the player or user of the handheld gaming machine 10 could customize the presentation of data on the secondary display 16 and/or the primary display 14. This may be accomplished, for example, by drag-and-drop selectable elements, pull-down menus, pop-up screens, selectable text, and/or selectable icons. For example, following a prompt of what video-feed to receive, a play of the handheld gaming machine 10 could, in succession, select a football icon, select a college icon, and then select a team icon from a list of available or upcoming college football games. The player may also be permitted to enable a "buddy list" to permit predetermined other people to know the player is on-line and to permit text-messaging or other communication between the player and a member of the player's buddy list. The handheld gaming machine 10 may also contain variants of the "buddy list" wherein, for example, fans of a particular team or competitor may opt into a linking together by the gaming establishment with other like fans or even into a larger group of like-minded unknown fans and unknown fans of an opposing team or competitor. In other aspects of the present concepts, the secondary display 16 may be configured to permit access to the internet to permit players to, for example, check email accounts, surf the web, or access specific web-sites or accounts.

The handheld gaming machine 10 may further be used, in accord with at least some aspects of the present concepts, as an extension of a player's other personal electronic devices. For example, the handheld gaming machine 10 may support connections to a player's cellular telephone through a data link (e.g., Bluetooth®, USB cable, IrDA, etc.), which may optionally comprise a compartment or cradle into which the player's phone may be secured, such as for a USB or IrDA connection. The handheld gaming machine 10 may, itself, provide enhanced electronics (e.g., transceiver, transmitter, antenna, power, etc.) to improve both reception and transmission of data. The gaming establishment may also utilize other devices, external to the handheld gaming machines 10, to facilitate telecommunications within selected portions of the gaming establishment. In these aspects of the present concepts, the player could plug in or synchronize his or her cell phone to the handheld gaming machine 10 and utilize the handheld gaming machine 10 earpiece or headphones to make or receive telephone calls during a gaming session. The use of the handheld gaming machine 10 in this manner may optionally require a one-time activation fee, connection fees, subscription fees, or a usage fee by the gaming establishment.

In another aspect, GSM (Global Services for Mobile) cellular phones utilize a removable and replacement computer memory chip commonly referred to as a SIM (Subscriber Information Module). The SIM stores a user's account information and phone number as well as a personal phone directory, text messages, and various other user settings. The handheld gaming machine 10 could be equipped with a SIM port, slot or receptacle that would enable players with GSM phones to simply temporarily remove the SIM from their personal cellular phone and removeably install it within the handheld gaming machine 10 so as to effectively turn the handheld gaming machine 10 into a cell phone for so long as the player desires. Since SIMs may be dimensioned to work only with telephones of certain service providers, it may be advantageous to include a plurality of ports, slots or receptacles to accommodate a number of different SIM designs. In still another alternative, the gaming establishment could provide a pre-paid SIM, or a SIM to which value could be added, to a player desiring voice-telecommunication capabilities while playing the handheld gaming machine 10. The gaming establishment providing handheld gaming machines 10 with such SIM port(s), slot(s) or receptacle(s), or the like, could limit access (e.g., fee-based access) by, for example, unlocking or providing access to the port for a player only upon payment of a fee or upon satisfaction of another condition for use.

Figure 3B:
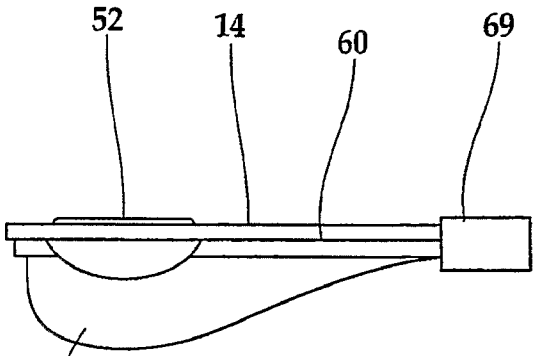
FIGS. 3(*a*)-(*c*) are perspective and side views of a handheld gaming machine in accord with at least some aspects of the present concepts, FIG. 3(*b*) showing a side view of the handheld gaming machine in an open or inclined configuration and FIG. 3(*c*) showing a side view of the handheld gaming machine in a closed or planar configuration.
Figure 3C:
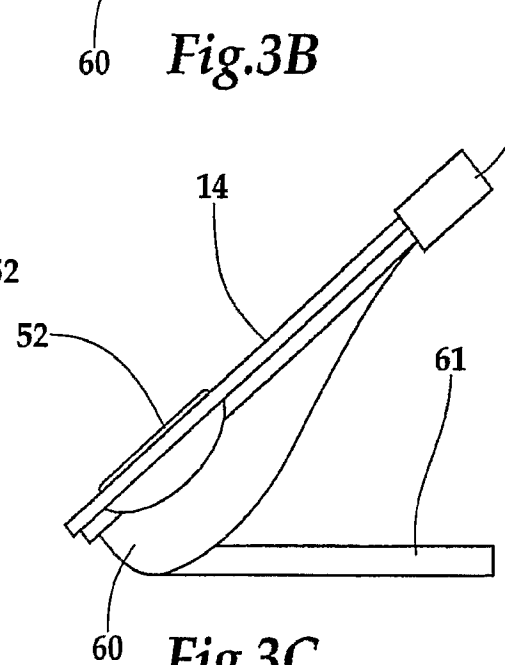
Figure 3A:
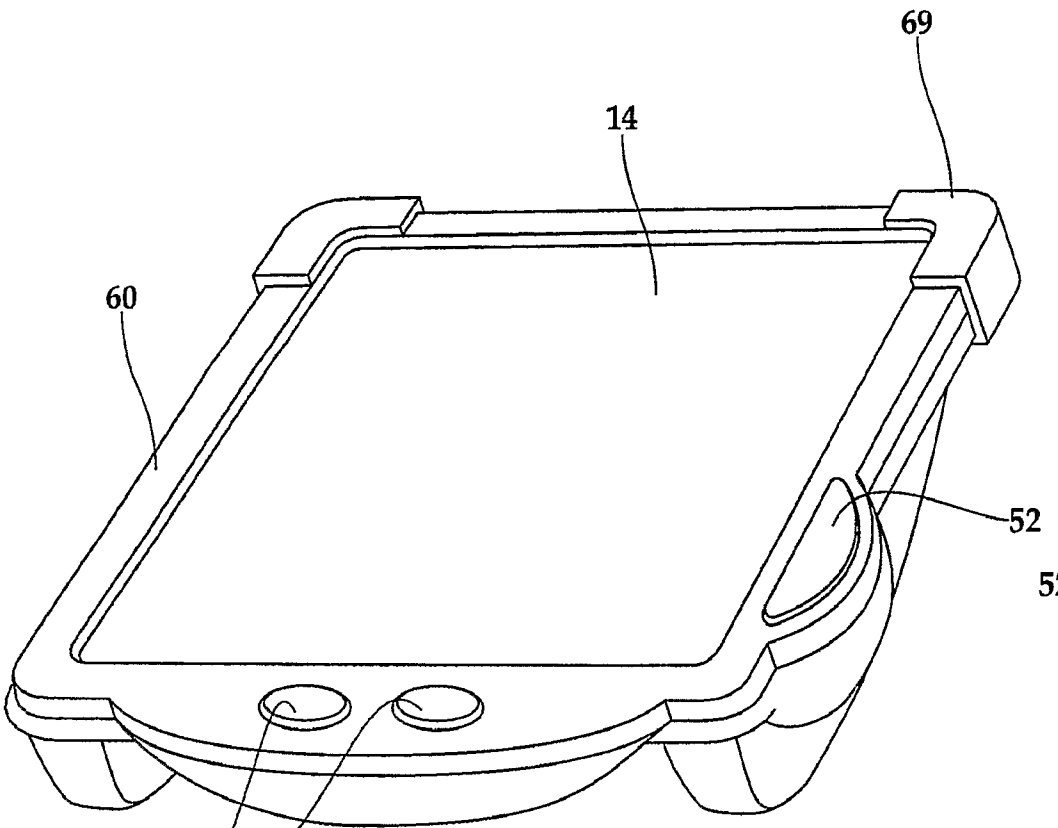

In the illustrated embodiments of FIGS. 1, 3(*a*), 3(*c*), and 4, the handheld gaming machine 10 is shown in a "planar" configuration in which the primary display 14 is oriented substantially along a plane of the base or casing of the handheld gaming machine 10. Alternatively, such as is shown in FIG. 3(*b*), the primary display 14 may be slanted at any one of a predetermined number of fixed angles (e.g., 5°, 10°, 15°, 20°, 25°, 30°, 45°, etc.) or at a variable angle (i.e., adjustable between 0°-180°) to a plane of the base 61 of the handheld gaming machine 10. The primary display 14 may also be slanted at an angle between 0°-360°, as may be applicable for a given connection between the base or casing of the handheld gaming machine 10 and the display 14.

One advantage to embodiments of the handheld gaming machine 10 which permit moving the casing 60 and primary display 14 relative to a supporting base 61, such as shown by way of example in FIG. 3(*b*), is improved heat dissipation away from a player. Where the battery of the handheld gaming machine 10 is disposed within casing 60, the separation of the casing 60 from the base 61 permits the heat sources (e.g., the controller 34, the battery, etc.) to be moved away from the base, thereby permitting convective heat transfer to the ambient environment rather than conductive and convective heat transfer to a player's lap. In configurations utilizing a base 61, or even in configurations omitting a base 61, a back surface of the casing 60 could comprise a plurality of heat sink fins (e.g., extending across a back surface of the casing) to conduct heat away from the heat sources within the casing, thereby avoiding the need for internal fans and external vents. In some respects, this arrangement could facilitate cleaning of the handheld gaming machine 10 by eliminating openings in the handheld gaming machine. Other compartments could similarly be configured (e.g., sealable compartments and openings using resilient gaskets) to permit temporary wetting and/or immersion of the handheld gaming machine 10. In other respects, a wide coverage of heat sink fins on the back surface of the casing 60 would distribute heat from the heat sources more evenly across the back surface of the casing and mitigate, if not eliminate, "hot spots".

Still further, the primary display 14 may be rotatable about a plurality of axes (e.g., rotatable upwardly or downwardly and to the left or right). The optional secondary display 16 may be fixed, relative to either the base 61 of the handheld gaming machine 10 or of the primary display 14, or may be independently adjustable relative to either or both of the base of the handheld gaming machine 10 and the primary display 14. For example, the secondary display 16 may be tiltable relative to the primary display 14 so that the player may view the primary display from a different viewing angle than the secondary display.

The base 61 and/or casing 60 of the handheld gaming machine 10 could comprise any configuration by which the orientation and/or position of the handheld gaming machine may be controlled by the player and/or by which the primary and/or secondary displays 14, 16 could be oriented in a position suitable to the player. In the most basic form, the base 61 or a bottom surface of the casing 60 of the handheld gaming machine 10 could comprise a substantially planar surface permitting the handheld gaming machine to be placed stably on a planar surface such as, but not limited to a table-top or a generally level surface. In at least some embodiments of the handheld gaming machine 10 comprising a casing 60 and a base 61, such as shown in the example of FIGS. 3(*a*)-(*c*), the casing 60 is shown to be rotatable relative to the base 61, which permits the primary display 14 resident in the casing to be inclined relative to a surface on which the base rests. For example, as shown in the handheld gaming machine 10 of FIGS. 3(*a*)-(*c*), a player could place the handheld gaming machine on a substantially planar surface, which could be angled relative to the horizontal, and rotate the casing 60 and primary display 14 to a preferred position.

Figure 4:
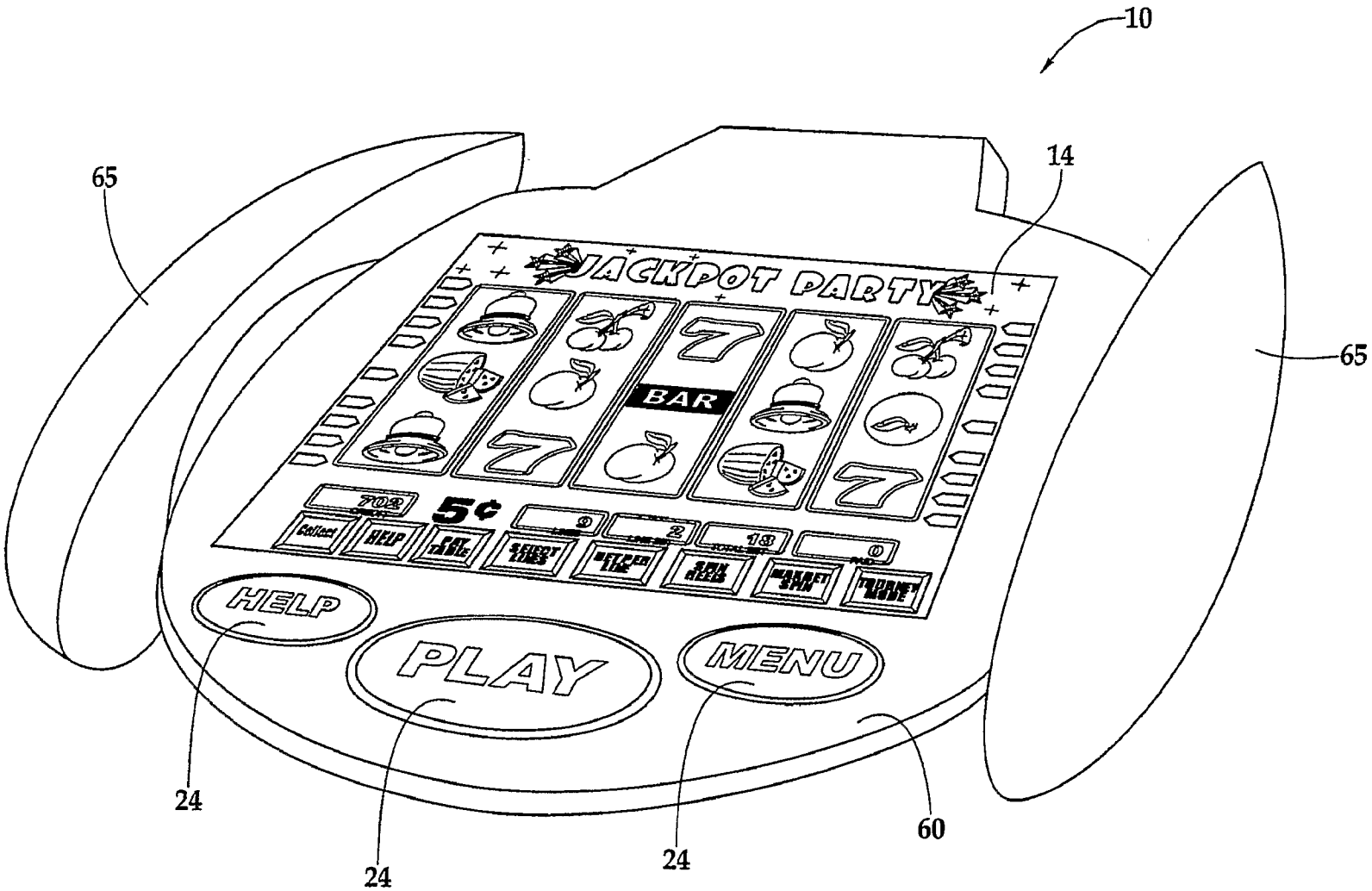
FIG. 4 is a perspective view of another handheld gaming machine in accord with at least some aspects of the present concepts.

The base 60, or a corresponding bottom surface of casing 60 of the handheld gaming machine 10, could optionally be contoured to mimic the curvature of a lap to facilitate placement of the handheld gaming machine in a player's lap. Handles 65 could optionally be integrated with the casing 60 or base 61, such as shown in FIG. 4. Handles 65 could, in at least some embodiments, comprise alternate functions or features, such as player inputs 24 (e.g., buttons and/or controls linked to at least one of the handheld gaming machine functions and/or wagering game play) or haptic devices (e.g., to produce vibrations corresponding to an event). In a related aspect, the casing 60 itself may be equipped with haptic devices to cause vibration of the entire handheld gaming machine 10. The handles 65 may be, in various aspects, rotatable relative to the casing 60 or base 61 to which the handles are attached. The handles 65 may also or alternatively be interchangeable and/or configurable to suit a user's preferences. For example, different handle 65 sizes could be provided to suit players with different hand sizes or comfort levels. Different materials could be provide to, for example, increase a coefficient of friction of the handle 65 to a desired level, increase the resiliency of the grip (e.g., sponge rubber), wick-away moisture, resist bacterial growth, facilitate cleaning, and/or to maximize heat dissipation. Different handles could also be imbued with different functionalities, button and/or control placements, and/or ergonomic features to permit a player to select handles most suited to the player's preferred player inputs 24.

In at least some embodiments, the handheld gaming machine 10 may be configured or configurable to permit attachment of the handheld gaming machine to a clip, a belt clip, a wrist strap, a forearm strap, a neck strap, a walker, a motorized cart, or other attachment device connected to a wearable item. Particularly with respect to an embodiment wherein the primary display 14 comprises a heads-up display and a player input device 24 may be separated from, but connected to the controller and/or other electronics by a wireless or hardwired connection, the remainder of the controller and/or other electronics may be disposed in any convenient location (e.g., on a waist pack or belt clip) and may even reside partially or fully within the headset comprising the heads-up display.

Ideally, the casing 60 is configured to permit a player to comfortably hold the handheld gaming machine 10 in one hand or two hands (e.g., via a handle 65, such as shown in FIG. 4), set the handheld gaming machine down on a surface (e.g., a table, a lap, etc.), or release the handheld gaming machine entirely (e.g., to be retained on a belt clip or neck strap), to permit the player to at least temporarily utilize one or both hands to perform some other function or action such as, but obviously not limited to, opening a bottle, eating food, gesticulating to someone, taking medicine, or resting the hands or arms. To prevent player's from inadvertently walking away from or losing control of the handheld gaming machine 10, the players may be provided with a wireless alarm device which may be worn, for example, on a belt or on a neck strap or placed in a pocket. The alarm device would be synchronized with the particular handheld gaming machine 10 and would be configured to sound an alarm if the alarm and the handheld gaming machine are separated by a predetermined distance without the particular alarm being disabled by entry of appropriate instructions to the alarm through the handheld gaming machine or other authorized device. Such alarm could be distance or signal strength dependent comprising, for example, a weak transmitter in the alarm and a receiver housed within the handheld gaming machine or a weak transmitter in the handheld gaming machine and a receiver housed within the alarm. The alarm could comprise a variety of alarm levels (e.g., a gentle reminder chirp at a separation of 3-4', a loud continuous shrill noise at a separation of 8'). The handheld gaming machine 10 may also be configured to, independently or concurrently with the activation of an alarm, shut-down, stand-by, and/or automatically initiate an emergency call to a gaming establishment employee, station, or computer.

In at least some aspects of the present concepts, the casing 60 is designed for rugged use. In general, conventional measures used to protect portable electronic devices, such as DVD players and computers, are also advantageously utilized in the handheld gaming machine 10 of the present concepts. In at least some examples, the exterior of the casing 60 may be rubberized or provided with one or more external removable/replaceable shock-absorbing devices 69 (see, e.g., FIGS. 3(*a*)-(*c*)) or may additionally or alternatively comprise a removable/replaceable shock-absorbing shell or shell components. The external shock absorbing devices 69 preferably comprise a resilient material (e.g. rubber, foam rubber, etc.) or a rigid frangible material (e.g., a crumple-zone). The casing 60 itself could also or alternatively comprise a plurality of integrated or internal replaceable shock-absorbing portions which absorb impact energy and deform in a destructive manner to absorb energy, similar to a crumple zone in an automobile. Portions of such modular shell which are plastically deformed or structurally compromised could be removed and replaced. In at least some embodiments, the electronics, boards, and internals of the handheld gaming machine 10 may be mounted within the casing 60 using conventional vibration-dampening mounts to dampen movement and vibration of the electronics, boards, and internals along one or more axes of translation and/or rotation and to minimize the impact of shocks or high amplitude impulses. The primary display 14 mounting may also comprise shock absorbers and/or shock absorbing materials.

Another feature of the handheld gaming machine 10 of the present concepts could include a locking keyboard or locking player inputs 24. In accord with this feature, a player could unilaterally elect to lock all of the keyboard or locking player inputs 24 or selected keyboard or locking player inputs to prevent inadvertent pressing of player inputs (e.g., push buttons 26), such as a "play" or "spin" button or changing wager inputs when the player is-not, in fact, playing the game. In one aspect, the player could press a predetermined sequence or combination of push buttons 26 or other player inputs 24, such as pressing a "power off" or "stand by" button. Alternatively, the handheld gaming machine 10 could be configured to automatically lock all of the keyboard or locking player inputs 24 or selected keyboard or locking player inputs to prevent inadvertent pressing of player inputs following a predetermined period of inactivity (e.g., 10 seconds, 30 seconds, 1 minute, etc.). To unlock the handheld gaming machine 10, the player could press a predetermined sequence of or combination of push buttons 26 or other player inputs 24 to reactivate the handheld gaming machine. In still additional aspects, the locking keyboard or locking player inputs could be removed or bypassed by a player through the use of biometric player information reader 52, which would suitably identify the player and the player's intent to resume play. In another embodiment, the keyboard or player inputs 24 could be enabled only when the player is holding the handheld gaming machine 10 by both handles 65. In this embodiment, each handle 65 could comprise a conductive surface which would complete a circuit when the player is holding each handle, such as a bioelectrical impedance detector. Using this interlock, the keyboard or player inputs 24 would not be active if the player sets the handheld gaming machine 10 down or holds the handheld gaming machine with one hand.

The handheld gaming machine 10 is preferably updatable to permit the installation of new hardware and/or modification of existing software through a hardwired port or electrical connector or through a wireless connection (e.g., wireless broadband). For example, when a handheld gaming machine 10 is returned to a kiosk or docking station 125 from which it was removed by a player, such as when the player is done using the handheld gaming machine or merely wants to recharge the battery and continue playing, software version information could be checked and the handheld gaming machine updated, if necessary. During an updating operation, the primary display 14 could be configured to display a message such as, but not limited to, "Out of Service" to discourage removal of the handheld gaming machine. Similarly, if the player intends to use the same handheld gaming machine 10 following recharging of the battery, he or she may optionally be permitted to "save" the handheld gaming machine and have the primary display 14 display "Reserved for Mr. X" or "Reserved for Ms. Y" or the like during charging. To facilitate battery charging and continued play of the handheld gaming machines 10, battery charging stations could be distributed about designated places within the gaming establishment such as, but not limited to, bar tops, table tops, seats, and chairs. In one aspect, the battery charging stations could comprise a device for inductive charging of the batteries, so that a mere placement of the handheld gaming machine on the bar while the player is sitting at the bar would be sufficient to recharge the battery.

In at least some embodiments of the present concepts, the player may be able to, upon checking out the handheld gaming machine 10 from a kiosk 125 or attendant, select which wagering game or wagering games are to be loaded into the handheld gaming machine or otherwise made accessible (e.g., the games are already loaded into the machine but are selectively enabled by entry of appropriate access codes). A player may therefore elect to have one game loaded into handheld gaming machine or may elect to have five games loaded into handheld gaming machine. When all of the selected games have been uploaded or rendered accessible, the player may then be allowed to take the handheld gaming machine 10. It at least some other embodiments, the player may be permitted to remotely update the configuration using wireless transmissions (e.g., wireless broadband). In these embodiments, a player may not wish to return to a kiosk 125 or attendant and may instead request enablement of an additional game or games. The player may then send a request through the handheld gaming machine 10 to an external system 50 managing and/or monitoring game play, player inputs, handheld gaming machine 10 communications, or other matters relating to the handheld gaming machine. The external system 50 could then output an authorization code to provide access to enable the additional game or games requested by the player following verification of pre-determined preconditions, if any. For example, such preconditions could include fee-based conditions such as, but not limited to, payment of an additional fee by the player for access to such game or games or status-based conditions such as, but not limited to, membership in a gaming establishment club or achievement of certain outcomes in a game. Alternatively, the external system 50 could output, through a wireless connection, necessary software to enable play of the requested game or games on the handheld gaming machine 10 requested by the player following verification of the optional pre-determined preconditions.

In at least some aspects of wagering game play on the handheld gaming machine 10, the player may, as noted above, buy a block of games to play in any of a plurality of predetermined block sizes (e.g., 100, 200, 250, 500, 1000 games). The pre-determined block sizes may include any number of games and may optionally be incremented in groupings of 5, 10, 20, 25, 50, or 100, for example. In at least some aspects, the block of games could be played sequentially, with an external system 50 independently determining a random outcome for each game played on the handheld gaming machine 10 and transmitting the determined random outcome to the handheld gaming machine controller 34. In at least some other aspects of the present concepts, the purchase of the block of games comprises a purchase of a plurality of predetermined random outcomes corresponding in number to the number of games in the block of games. In one aspect of game play, the handheld gaming machine 10 controller stores the predetermined random outcomes and awards an award for each predetermined winning outcome in accord with a wager placed by the player during game play. The award information corresponding to the predetermined winning outcome(s) is then transmitted to the external system 50 managing the game for verification and registration of the award amount. The verification could include any security measures by which the authenticity of the transmission from the handheld gaming machine 10 may be verified. In one example, the block of games comprising the predetermined winning outcome(s) could be reduced to a code (e.g., 0's for losing outcomes and 1's for winning outcomes) stored in the external system 50 for later comparison to an award notification transmission by the handheld gaming machine 10. In another example, the player may be required to pre-designate the bets to be placed in the block of games when the handheld gaming machine 10 is checked out (e.g., a uniform Max bet across all plays, a Max bet for the first ½ of the plays and a Min bet for the second 12 of the plays, etc.). In this example, the external system 50 can immediately determine what award should be credited to a player's account by multiplying the predetermined winning outcome(s) with the pre-selected wagers. In other examples, bonus games may permit independent selection of objects that may involve random outcomes determined by the handheld gaming machine controller 34. Alternatively, the determination of random outcomes in some games may be controlled by a controller in the external system 50.

To reduce the incidence of misappropriation of the handheld gaming machine 10, all winnings associated with a handheld gaming machine for a purchased block of plays or for wagers placed thereupon may be automatically credited to the player who checked out the handheld gaming machine. In other words, the handheld gaming machine 10 may be configured so as not to permit a destination of funds or winnings associated therewith to be changed by a person in possession of the handheld gaming machine. Thus, if a player checks out the handheld gaming machine 10 and purchases a block of plays (e.g., 200 spins) and then another person steals the handheld gaming machine, the predetermined winning outcome(s) would automatically be associated with the player.

Another aspect of game play for at least some embodiments of the handheld gaming machine in accord with the present concepts includes an auto-play setting. If, for example, a player wants to sit down an eat dinner, but does not want to be encumbered by actively pressing player inputs 24 to cause game play to progress, the player may activate an auto-play feature. The handheld gaming machine 10 would be configured by the player to execute plays at specified wagers and/or at a specified rate and/or with random selections of selectable elements if appropriate to the selected game. In this manner, the player can passively watch the progressive reveal of the pre-determined random outcomes while engaged in other activities.

To enhance the security of the handheld gaming machine 10, the handheld gaming machines 10 may be configured only to operate within a predetermined public area and/or predetermined private area (e.g., a private lounge). If the handheld gaming machine 10 is removed from such predetermined area(s), it will stop working. In this respect, the handheld gaming machine could be configured to automatically shut down within a predetermined period of time (30 seconds) if it does not receive an enabling code broadcast by the external system 50. For example, the external system 50 could be configured to wirelessly broadcast an enabling code recognizable by the handheld gaming machine 10 within the predetermined area(s) every second or every five seconds. When the handheld gaming machine 10 registers the enabling code, it will reset a timer that will permit a predetermined period of play (e.g., 30 seconds, 1 minute, etc.). If the handheld gaming machine 10 is removed from the predetermined area(s) which receive the enabling code broadcast by the external system 50, the handheld gaming machine 10, absent any enabling code to reset the internal shut-down timer, will time out within a predetermined period of time (e.g., 30 seconds). The handheld gaming machine 10 may optionally display to the user the countdown timer with an associated warning and/or issue an audible alarm if the timer passes a predetermined point (e.g., 10 seconds remaining), indicating that the handheld gaming machine has failed to receive one or more enabling codes. This would permit the player time to return to the predetermined area(s) of use of the handheld gaming machine 10.

In another aspect, exits from the predetermined area(s) may broadcast a localized (i.e., confined to the immediate area of the exit) disabling code to start a timer to disable a handheld gaming machine 10. The disabling code may be cleared by, for example, returning the handheld gaming machine 10 to a kiosk 125, attendant, external system 50 connection, cradle, or the like within the predetermined area (s), whereupon the presence of the handheld gaming machine within the predetermined area(s) may be established. The handheld gaming machine 10 may be configured to issue an alarm (e.g., vibration, video display, audio output, and/or visual output using lighting) when placed in proximity of the devices broadcasting the localized disabling code. This alarm may be in response to detection of the disabling code or may be in response to a separate alarm code broadcast by the same or another device disposed adjacent the exits to the predetermined area(s). In this aspect, the handheld gaming machine may optionally enable receipt of the disabling code only when the alarm has been active for a predetermined period of time (e.g., 1 second) receipt of the predetermined area(s).

In still other aspects, the security of the handheld gaming machine 10 may improve by equipping each handheld gaming machine 10 with a positioning unit which displays and/or logs a position of the handheld gaming machine relative to predetermined boundaries of the above-noted predetermined area(s). The handheld gaming machine 10 may be configured to issue an alarm (e.g., vibration, video display, audio output, and/or visual output using lighting) when the handheld gaming machine 10 is brought to within a predetermined distance of such predetermined boundaries. The type of alarm and intensity of the alarm may be scaled in relation to the distance between the handheld gaming machine 10 and a predetermined boundary. For example, the player could be given a gentle reminder when the handheld gaming machine 10 is three feet from a predetermined boundary, a sharp reminder when the handheld gaming machine is two feet from the predetermined boundary, a strong reminder when the handheld gaming machine is one foot from the predetermined boundary, and a continuous loud alarm when the predetermined boundary has been exceeded. In still other aspects, the handheld gaming machine 10 may itself wirelessly alert external systems 50 and/or security personnel for the gaming establishment if the handheld gaming machine is detected within a predetermined distance (e.g., 1 foot) from a predetermined boundary or at a predetermined distance outside of a predetermined boundary so that, for example, security cameras may be directed toward and focused on the person holding or suspected of holding the handheld gaming machine 10.

To further enhance security, the handheld gaming machine 10 may comprise measures to discourage inappropriate use. One such measure could include an on-board camera, such as those provided in cell phones, that automatically takes a picture of the player when a wagering event has been activated (e.g., a "pull" of the handle for a slots game). This video data could then be transmitted to an external system 50 for temporary storage should a dispute arise over gaming activity or personal responsibility. The video data could be used to confirm, for example, whether or not a player's spouse or child picked up the handheld gaming machine and played wagering games thereon unbeknownst to the player. More active restrictions could also be implemented. A player may be assigned a personal code when the player checks out a handheld gaming machine 10. This code must be entered to initiate play and may be required to be re-entered periodically to continue game play. In still other aspects, the player identification button 52 may be a biometric device configured as a mandatory interlock for the wagering game, such that each turn, spin, or wagering event must be activated by an input through the biometric player identification button 52. Thus, to activate each turn, spin, or wagering event, the player must press their finger against a biometric player identification button 52 to positively identify the player. The player may then press an appropriate button on the console, possibly within a predetermined period of time (e.g., 1 second, 5 seconds) to initiate the turn, spin, or wagering event. The player's pressing of the biometric player identification button 52 could itself be configured to be an instruction to initiate the turn, spin, or wagering event or the button used to initiate the initiate the turn, spin, or wagering event could comprise a separate biometric device distinct from biometric player identification button 52.

In the above-described aspects utilizing biometric player identification features 52, a first identified player biometrically recognized by an associated external system 50 may conduct a first session of wagering games and may then directly hand the handheld gaming machine 10 to a second identified player (e.g., the first player's spouse or friend) biometrically recognized by the associated external system to conduct a second session of wagering games. Since each player is independently recognized by the associated external system 50, the winnings and losses of each player will be individually and automatically associated with the accounts of the respective one of the first and second player since each turn, spin, or wagering event is associated to a particular player by virtue of the biometric identification/verification. Moreover, the biometric player identification feature(s) 52 may be used to enable each turn, spin, or wagering event such that an unauthorized user (e.g., a minor child of a player) would be prevented from doing anything untoward with the handheld gaming machine 10.

In at least some other aspects, the security of the handheld gaming machine 10 may be enhanced by enabling the handheld gaming machine not with a biometric player identification feature(s) 52, but with an electronic player identification feature. In one aspect thereof, a secondary electronic device, such as a cell phone or PDA, may be synchronized with and associated with the handheld gaming machine 10 such that when the two devices are separated sufficiently to reduce a strength of the wireless connection to below a predetermined threshold, the handheld gaming machine disables itself. In another aspect, a player could be assigned a portable enabler (e.g., a "key fob") that the player may wear on a neck strap or may put in their pocket or on their person. When a separation between the handheld gaming machine 10 and the portable enabler is sufficiently great to reduce a strength of the field or signal therebetween to below a predetermined threshold, the handheld gaming machine disables itself.

An additional security measure to thwart unauthorized use of a handheld gaming machine 10 in another gaming establishment could include the use of proprietary SIMs having inherently limited life spans, which would require periodic replacement. Still further, as noted above, the handheld gaming machine 10 could require periodic (e.g., daily) updates with new software, codes, updates, instructions, or the like. These periodic updates could also reset a shutdown timer in the handheld gaming machines 10. So long as the handheld gaming machine 10 is retained by the gaming establishment and updated periodically, on schedule, the handheld gaming machine will continue to operate properly. However, should the handheld gaming machine 10 be removed from the gaming establishment and fail to receive the periodic update, the shutdown timer will not be reset and the handheld gaming machine will cease to operate.

In still other aspects of the handheld gaming machine 10 in accord with the present concepts, the handheld gaming machine may comprise a personal electronic device such as, but not limited to a cell phone, rather than a device exclusively dedicated to wagering game play. Personal electronic devices, such as a cell phone, which will be used in the following examples, comprise a plurality of push buttons and other inputs such as, but not limited to key pads, quick keys, scrolling wheels, joysticks, touch pads, and touch screen keys. These inputs may be utilized as selection devices and inputs for a wagering game played on the personal electronic device. Suitable wagering games may include, but are not limited to, keno, bingo, blackjack, poker, slots-type games, picking games, word games, roulette, and card-games. The personal electronic devices are also conventionally provided with ample data input ports (e.g., Bluetooth®, USB, firewire, etc.) through which instructions may be input into the personal electronic devices (e.g., updated programming, ring tones, control codes, etc.). In accord with at least some aspects of the present concepts, a player may place his or her personal electronic device, hereinafter a cell phone by way of example, into a docking station or other position wherein a wireless communication path may be established, whereupon an external system 50 may upload/download the wagering game software into the cell phone.

Although the term "personal electronic device" is provided above, this terminology does not exclude electronic devices sold by the gaming establishment to a player or given to a player by the gaming establishment. In one example, a gaming establishment may purchase and sell (or give away) customized cell-phones having at least one of gaming establishment logos, trademarks, and/or colors; game specific logos, trademarks, and/or colors; game specific software; game specific skins, gaming establishment specific skins; and/or color schemes or shapes corresponding to a gaming establishment preferred player's club hierarchy (e.g., silver, gold, platinum, diamond, etc.). The above-noted logos, trademarks, and/or colors may reside on face-plates attached to a cell phone or on a skin or carrier for the cell phone. In some instances, a gaming establishment may give such personal electronic devices to preferred players. In other instances, a gaming establishment may partner with communication service providers to provide attractive service packages to entice players to obtain, for a nominal fee, a phone pre-enabled to play wagering games at the gaming establishment. Such personal electronic devices, which may optionally be customized to facilitate wagering game play, may include additional features to enhance the game play experience.

The above-noted personal electronic devices, particularly those which might be customized and/or provided by a gaming establishment, may comprise keys and/or buttons having lighting which may be utilized for game play. For example, the lights of a cell phone may be activated to correspond to events in the wagering game or to highlight selection options available to a player. The lights associated with the keys and/or buttons of the cell phone, or other personal electronic device, could be configured to individually turn on or off in response to wagering game related instructions executed by the cell phone controller. The turning on and off of the lights associated with the keys and/or buttons may, for example, occur randomly or in a pre-determined sequence. The lighting may also provide guidance to a player such as, but not limited to, highlighting selectable elements which may be selected by a player. In at least some embodiments, the lights may comprise a back-light visible through the keys and/or buttons, or portions thereof. In other embodiments, the lights may at least partially circumscribe the keys and/or buttons. For example, a button may be encircled by a light transmissive material to which light is piped from one or more light sources. In this aspect, the light source(s) may comprise a plurality of colored lights, any one of which may be directed to a light transmissive material surrounding a designated button to cause the designated button to be illuminated in any one of a plurality of colors. For example, an array of nine selectable elements of different colors may be displayed with respect to a bonus game and, depending on color, of the selectable element selected by the player, the buttons on the phone may light up (e.g., red, green, yellow, etc.) to show either the color that was picked or, alternatively, a color or color(s) that contained a winning outcome. Additional personal electronic device outputs such as, but not limited to vibration or audio output, may also be used to communicate information to a player. In the example above, if a player selects a winning selectable element, the personal electronic device could display the color of the selected winning selectable element and activate a vibration device.

Once a wagering game has been loaded into a cell phone, for example, the player may utilize the cell phone buttons as player inputs 24 for the wagering game. In at least some embodiments, the external system 50 may determine a configuration of the cell phone against a library of known cell phone keyboard and input configurations to specifically tailor the wagering game inputs to particular keys on the cell phone. In at least some other embodiments, the external system 50 may also upload/download a program wherein a player is guided through an input assignment process to assign a unique input to each potential input required in the wagering game. As with at least some of the previously mentioned embodiments, predetermined random outcomes determined by an external system 50 controller may be stored in a memory resident in the cell phone. The player may then place wagers, as desired, whereupon the predetermined random outcomes are sequentially revealed. The award associated with the players predetermined winning outcome(s) would then be stored in the cell phone for later transmission to the external system 50 for verification and disbursement or could be automatically transmitted to the external system 50 for immediate verification and disbursement.

As noted above, wagering game play, which includes any bonus or secondary games, may be controlled by any combination of cell phone input device. The wagering game may be configured to receive inputs only through the conventional character set common to every cell phone (e.g., numerals 0-9, "*" and "#"). Additionally or alternatively, the wagering game may be configured to display selectable elements on the cell phone display and the player may select a selected one of the selectable elements using a cell phone cursor navigation feature (e.g., a joystick, touch pad, touch screen, scrolling wheel, etc.). The inputs may also comprise audio or voice inputs from a player through, for example, a microphone in the cell phone or a microphone in a headset.

In still another aspect of wagering game play on the cell phone (or other personal electronic device), the wagering game may be configured to sequentially highlight selectable elements displayed on the cell phone display and the player may select a selected one of the selectable elements by simply pressing an "enter," "select," "stop," or "ok" button, or the like (e.g., a designated button, such as the "5" button), when the desired selectable element is highlighted. Such sequential highlighting of the selectable elements could permit the player a predetermined period of time in which to make the selection. For example, where five selectable elements are presented, each selectable element could be highlighted sequentially from left to right, each selectable element being highlighted for one second. The sequential highlighting would continue and repeat until a player makes a selection. The wagering game may further be configured to permit a player to accelerate the sequential highlighting (e.g., via a designated "pass" button) to more quickly highlight a desired selectable element.

In accord with other aspects of the present concepts, a personal electronic device (e.g., a cell phone) may be enabled, through the above-noted software and player inputs, to connect the personal electronic device directly to a stand-alone or upright wagering game machine and use the personal electronic device for the player inputs 24. In other words, a player could use their own enabled (i.e., gaming establishment and/or gaming manufacturer software installed therein) and approved (e.g., authenticated in association with a known player) personal electronic device and connect it directly to a stand-alone or upright gaming machine (e.g., through a USB cable and port, Blackberry® wireless connection, or other wireless connection). In this configuration, the player may use their own personal electronic device to control the game play on the stand-alone or upright gaming machine.

It at least some embodiments, it is desired that the handheld gaming machine 10 includes devices and/or systems to protect the handheld gaming machine from losses of power, such as a degraded battery, and to preserve any data or game related information in the event of a power loss. In one aspect, every event of the wagering game is stored in a memory device residing within the handheld gaming machine and/or transmitted by the handheld gaming machine to an external system 50 for storage in a memory device associated with the external system. Further, it is preferred that the handheld gaming machine 10 provide notification to the player of a low battery or of other conditions which might require return of the handheld gaming machine to a kiosk 125, attendant, or other gaming establishment employee. Such notification could comprise, but is not limited to, a message displayed on the primary display 14, an audio tone or message conveyed over speaker 19, and/or a forced stand-by of the handheld gaming machine to preserve data, if necessary.

Each of these embodiments and obvious variations thereof is contemplated as falling within the spirit and scope of the claimed invention, which is set forth in the following claims. In a further expression of the embodiments described above, it is to be understood that the term handheld is not to be construed literally and is, instead, generally used to refer to portable wagering game machines. For example, as described above, a "handheld" or portable wagering game machine could comprise a wearable heads-up display, a controller and other electronics contained within a casing attachable to a belt, and wearable player input devices (e.g., on a forearm strap). In other aspects, the portable wagering game machine may be placed on a table top and played. In still another aspect, the handheld gaming machine 10 casing 60 or handles, if provided, may be configured with one or more mounting devices or ports configured to facilitate mounting of the handheld gaming machine onto a wheelchair, walker, or electric cart to enable a disabled individual or individual of limited mobility or manual strength and/or dexterity. Further, the handheld gaming machine 10 may comprise a communication port configured to enable communication between control devices associated with the wheelchair, walker, or electric cart (e.g., a joystick) so as to permit the player to operate the handheld gaming machine with an alternative user interface. In this regard, the handheld gaming machine may be configured to permit a player to electronically (e.g., wirelessly) link together a player's cellular telephone, PDA, smart phone, or the like, to a communication interface of the handheld gaming machine so as to permit the player to utilize his or her own cellular telephone, PDA, smart phone, or the like, as an input device. Thus, the handheld wagering game machines described herein broadly include portable wagering game machines which need not literally be held in one's hand.

What is claimed is:

1. A handheld gaming system, comprising:

a handheld gaming machine configured to play a wagering game;

a game controller configured to regulate wagering game play on the handheld gaming machine; and an external module removably affixed to the handheld gaming machine and communicatively coupled to the handheld gaming machine via a connection between the handheld gaming machine and the external module, wherein the external module is configured to be carried along with said handheld gaming machine, the external module including at least one of a specialty player input and a miniature game outcome indicator, the specialty player input, when actuated, providing an input to the wagering game conducted on the handheld gaming machine, the miniature game outcome indicator presenting an outcome of the wagering game conducted on the handheld gaming machine.

2. The handheld gaming system of claim 1, wherein the connection between the external module and the handheld gaming machine is a mechanical connection.

3. The handheld gaming system of claim 2, wherein the miniature game outcome indicator has a moving component to simulate play associated with the wagering game.

4. The handheld gaming system of claim 3, wherein the moving component is a mechanical reel or mechanical wheel.

5. The handheld gaming system of claim 2, wherein the mechanical connection is accomplished by snap together, male-female connectors.

6. The handheld gaming system of claim 1, wherein the external module is smaller than the handheld gaming machine.

7. A handheld gaming system, comprising:

a handheld gaming machine configured to play a wagering game;

a game controller configured to regulate wagering game play on the handheld gaming machine; and an external module removably affixed to the handheld gaming machine via a mechanical connection, wherein the external module is configured to be carried along with said handheld gaming machine, the external module including a mini-mechanical or electromechanical game outcome indicator with a moving component, the game outcome indicator presenting an outcome of the wagering game conducted on the handheld gaming machine.

8. The handheld gaming system of claim 7, wherein the game outcome indicator is a mechanical wheel or mechanical reel.

9. The handheld gaming system of claim 8, wherein the mechanical connection is accomplished by snap together, male-female connectors.

10. The handheld gaming system of claim 7, wherein the external module is smaller than the handheld gaming machine.

11. A handheld gaming system, comprising:

a handheld gaming machine configured to play a wagering game;

a game controller configured to regulate wagering game play on the handheld gaming machine; and an external module including a specialty push button, wherein the external module is configured to be carried along with said handheld gaming machine, said external module removably affixed to the handheld gaming machine, the specialty push button, when actuated, providing an input to the wagering game conducted on the handheld gaming machine.

12. The handheld gaming system of claim 11, wherein the specialty input button, when actuated, overrides a randomly determined outcome for the wagering game and substitutes one winning outcome selected from a plurality of pre-determined winning outcomes.

13. The handheld gaming system of claim 12, wherein the specialty input button is configured to be actuated for a predetermined number of actuations.

14. The handheld gaming system of claim 13, wherein the pre-determined number of actuations is conditioned upon a level of bets placed on the wagering game.

15. The handheld gaming system of claim 11, wherein the external module is smaller than the handheld gaming machine.

* * * * *